US008673528B2

(12) United States Patent
Sugimoto et al.

(10) Patent No.: US 8,673,528 B2
(45) Date of Patent: Mar. 18, 2014

(54) TONER, DEVELOPER, TONER ACCOMMODATING CONTAINER, PROCESS CARTRIDGE AND IMAGE FORMING METHOD

(75) Inventors: Tsuyoshi Sugimoto, Shizuoka (JP); Hiroshi Yamashita, Shizuoka (JP); Naohiro Watanabe, Shizuoka (JP); Shinichi Wakamatsu, Shizuoka (JP); Masaki Watanabe, Shizuoka (JP); Satoshi Ogawa, Nara (JP); Masana Shiba, Shizuoka (JP); Junichi Awamura, Shizuoka (JP); Naohito Shimota, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 194 days.

(21) Appl. No.: 12/994,167

(22) PCT Filed: May 22, 2009

(86) PCT No.: PCT/JP2009/059832

§ 371 (c)(1),
(2), (4) Date: Nov. 23, 2010

(87) PCT Pub. No.: WO2009/142338

PCT Pub. Date: Nov. 26, 2009

(65) Prior Publication Data

US 2011/0076607 A1 Mar. 31, 2011

(30) Foreign Application Priority Data

May 23, 2008 (JP) ..... 2008-135858

(51) Int. Cl.
*G03G 9/00* (2006.01)

(52) U.S. Cl.
USPC ..... 430/108.2; 430/108.8; 430/109.4

(58) Field of Classification Search
USPC ..... 430/108.1, 108.2, 108.8, 109.1, 109.4
See application file for complete search history.

(56) References Cited

U.S. PATENT DOCUMENTS

| | | | |
|---|---|---|---|
| 4,877,704 | A | 10/1989 | Takagiwa et al. |
| 6,579,653 | B1 | 6/2003 | Yuasa et al. |
| 7,364,828 | B2 | 4/2008 | Yamashita et al. |

(Continued)

FOREIGN PATENT DOCUMENTS

| | | | |
|---|---|---|---|
| CN | 1667517 | A | 9/2005 |
| CN | 1834795 | A | 9/2006 |

(Continued)

OTHER PUBLICATIONS

Extended Search Report issued Jun. 6, 2012 in European Patent Application No. 09750700.8-1217/2279456.

(Continued)

*Primary Examiner* — Stewart Fraser
(74) *Attorney, Agent, or Firm* — Oblon, Spivak, McClelland, Maier & Neustadt, L.L.P.

(57) ABSTRACT

A toner including at least one polyester resin serving as a binder resin, a colorant, a releasing agent, and a fixing aid, wherein the fixing aid includes a fatty acid amide-based compound, and the fatty acid amide-based compound is at least one of a fatty acid amide compound having a mono- or higher valent amide bond and a fatty acid amide-based compound having a mono- or higher valent amino group or a hydroxyl group.

17 Claims, 3 Drawing Sheets

(56) References Cited

U.S. PATENT DOCUMENTS

| | | | | |
|---|---|---|---|---|
| 7,396,630 | B2 | 7/2008 | Watanabe et al. | |
| 7,563,555 | B2 | 7/2009 | Watanabe et al. | |
| 7,824,835 | B2 | 11/2010 | Sugimoto et al. | |
| 2001/0051270 | A1* | 12/2001 | Yamashita et al. | 428/405 |
| 2005/0053858 | A1 | 3/2005 | Yuasa et al. | |
| 2006/0014094 | A1 | 1/2006 | Yuasa et al. | |
| 2006/0057482 | A1* | 3/2006 | Yuasa | 430/108.2 |
| 2006/0068312 | A1 | 3/2006 | Yamashita et al. | |
| 2006/0115760 | A1* | 6/2006 | Mitsuhashi et al. | 430/111.4 |
| 2006/0127789 | A1 | 6/2006 | Yuasa et al. | |
| 2006/0177756 | A1 | 8/2006 | Sugimoto et al. | |
| 2006/0210903 | A1 | 9/2006 | Ohki et al. | |
| 2007/0141498 | A1* | 6/2007 | Umehara | 430/108.21 |
| 2007/0243478 | A1* | 10/2007 | Maeyama | 430/108.2 |
| 2008/0280218 | A1 | 11/2008 | Sabu et al. | |
| 2008/0318148 | A1 | 12/2008 | Sugimoto et al. | |
| 2009/0074467 | A1 | 3/2009 | Seshita et al. | |
| 2009/0092917 | A1 | 4/2009 | Sugimoto et al. | |
| 2009/0104555 | A1 | 4/2009 | Wakamatsu et al. | |
| 2010/0035170 | A1 | 2/2010 | Sugimoto et al. | |
| 2010/0310980 | A1 | 12/2010 | Sugimoto et al. | |

FOREIGN PATENT DOCUMENTS

| | | | |
|---|---|---|---|
| EP | 0 164 257 | A2 | 12/1985 |
| EP | 0 164 257 | A3 | 12/1985 |
| JP | 3 168647 | | 7/1991 |
| JP | 3-168652 | | 7/1991 |
| JP | 4 70765 | | 3/1992 |
| JP | 2004-170782 | | 6/2004 |
| JP | 3773906 | | 2/2006 |
| JP | 2006 208609 | | 8/2006 |
| JP | 2006 215243 | | 8/2006 |
| JP | 2007-241241 | A | 9/2007 |
| JP | 2007-328043 | | 12/2007 |
| JP | 2008 76452 | | 4/2008 |

OTHER PUBLICATIONS

Canadian Office Action issued Nov. 1, 2011, in Patent Application No. 2,725,146.

Office Action issued Feb. 29, 2012, in Chinese Patent application No. 200980118524.8 with English translation.

International Search Report issued Jun. 30, 2009 in PCT/JP09/59832 filed May 22, 2009.

Office Action issued Jul. 16, 2013 in Japanese Patent Application No. 2009-123307.

Office Action issued Oct. 8, 2013, in Japanese Patent Application No. 2009-123307, filed May 21, 2009.

* cited by examiner

TONER, DEVELOPER, TONER ACCOMMODATING CONTAINER, PROCESS CARTRIDGE AND IMAGE FORMING METHOD

TECHNICAL FIELD

The present invention relates to a toner used for developing an electrostatic image in, for example, electrophotography, electrostatic recording and electrostatic printing; a developer containing the toner; a container accommodating the toner; a process cartridge employing the toner; and an image forming method employing the toner.

BACKGROUND ART

Image formation in, for example, electrophotography, electrostatic recording and electrostatic printing is performed in accordance with a series of steps: forming a latent electrostatic image on a latent electrostatic image bearing member (hereinafter may be referred to as a "photoconductor" or an "electrophotographic photoconductor"); developing the latent electrostatic image with a developer to form a visible image (toner image); transferring the visible image onto a recording medium such as paper; and fixing the transferred image onto the recording medium to form a fixed image.

The developer is mainly classified into one-component developers containing only a magnetic or non-magnetic toner and two-component developers containing a toner and a carrier.

In general, from the viewpoint of achieving desired energy efficiency, image fixation in electrophotography is widely performed with a heating roller method in which a toner image on a recording medium is fixed by directly pressing a heating roller thereagainst. The heating roller method requires a large amount of electric power for performing image fixation. In view of this, various attempts have been made to reduce electric power consumed for a heating roller from the viewpoint of energy saving. For example, there is often employed a method in which when no image is output, the power of a heater for a heating roller is set to a low level; and when an image is output, the power is increased to raise the temperature of the heating roller.

However, in this method, it takes about several tens of seconds (waiting time) to raise the temperature of a heating roller at a sleep mode to a temperature required for image fixing, which is inconvenient for users. Also, in another desired method for reduction of electric power consumption, a heater is completely off when no image is output. In order to attain energy saving based on these method, it is required that the fixing temperature of a toner itself be lowered to decrease the toner fixing temperature in use.

In accordance with development in electrophotographic technology, toners used in developers have been required to be excellent in low-temperature fixing property and storage stability (blocking resistance). As a result, attempts have been made to use polyester resins instead of styrene-based resins conventionally used for binder resins of toners, since polyester resins have a higher affinity to, for example, recording media, and have a better low-temperature fixing property than styrene-based resins. For example, there have been proposed a toner containing a linear polyester resin whose physical properties (e.g., molecular weight) have been defined at predetermined values (see Patent Literature 1), and a toner containing a non-linear, cross-linked polyester resin formed by using rosin as an acid component (see Patent Literature 2).

In an attempt to further improve image forming apparatuses in processing speed and energy saving, conventionally used binder resins for toners are not still sufficient to meet the recent market requirements, making it very difficult to shorten the required fixing time in a fixing step and to attain a sufficient fixation strength when using a fixing unit whose temperature has been lowered.

As disclosed in Patent Literature 2, the toner containing a polyester resin formed by using rosin is advantageously excellent in low-temperature fixing property. In addition, it is readily pulverized to enhance toner productivity in the pulverization method, which is advantageous. Meanwhile, when 1,2-propanediol (a branched alcohol having 3 carbon atoms) is used as an alcohol component, the formed toner has a better low-temperature fixing property, while maintaining offset resistance, than that formed by using an alcohol having 2 or less carbon atoms. In addition, such an alcohol is effectively used for preventing degradation of storage stability of the toner caused by decrease in glass transition temperature thereof, as compared with the case where a branched alcohol having 4 or more carbon atoms is used. When the polyester resins formed from rosin and/or the above alcohols are used for a binder resin of toner, the formed toner is advantageous in that it is fixed at low temperature and improved in storage stability.

Meanwhile, demand for energy saving is expected to be more and more strict in future. At present, use of polyester resin excellent in low-temperature fixing property is gradually improving toners in low-temperature fixing property more than before. But, when such a polyester resin is only used; i.e., unless some additional measures are taken, it is difficult to sufficiently meet requirements for energy saving in near future.

In recent years, toners have been improved in low-temperature fixing property by adding a fixing aid thereto (see Patent Literature 3). Patent Literature 3 proposed that the fixing aid is made to exist in toner as crystal domains to improve it in both heat resistance/storage stability and low-temperature fixing property. But, in accordance with the recent development in high-speed image forming apparatuses, toners have been required to have high durability and meet requirements for further energy saving. At present, difficulty is encountered in sufficiently meeting the aforementioned requirements and thus, demand has arisen for further improvement and development.

Patent Literature 1: Japanese Patent Application Laid-Open (JP-A) No. 2004-245854

Patent Literature 2: JP-A No. 04-70765

Patent Literature 3: JP-A No. 2006-208609

DISCLOSURE OF INVENTION

The present invention aims to solve the above-described problems pertinent in the art and to achieve the following objects. That is, an object of the present invention is to provide a toner which is excellent in low-temperature fixing property and offset resistance, which does not contaminate a fixing device and/or an image, and which forms a sharp, high-quality image for a long period of time; a developer containing the toner; a container accommodating the toner (toner accommodating container); a process cartridge employing the toner; and an image forming method employing the toner.

The present inventors conducted extensive studies in order to solve the above-described problems, and have found that a toner containing a polyester resin serving as a binder resin, a colorant, a releasing agent, and a fixing aid containing a fatty acid amide-based compound, the fatty acid amide-based compound being at least one of a fatty acid amide compound having a mono- or higher valent amide bond and a fatty acid amide-based compound having a mono- or higher valent amino group or a hydroxyl group can further improve in low-temperature fixing property.

Furthermore, the present inventors have found that the fixing aid used the present invention exists independently from a binder resin before heating at a fixing portion and thus, does not degrade thermal characteristics of the binder resin to thereby maintain desired heat resistance/storage stability of the toner.

The present invention is accomplished on the basis of the above findings obtained by the present inventors, and the means for solving the problems are as follows.

<1> A toner including:

at least one polyester resin serving as a binder resin, a colorant, a releasing agent, and a fixing aid, wherein the fixing aid includes a fatty acid amide-based compound, and the fatty acid amide-based compound is at least one of a fatty acid amide compound having a mono- or higher valent amide bond and a fatty acid amide-based compound having a mono- or higher valent amino group or a hydroxyl group.

<2> The toner according to <1> above, wherein the fatty acid amide-based compound has a melting point of 70° C. or higher and lower than 120° C.

<3> The toner according to any one of <1> and <2> above, wherein the fatty acid amide-based compound is any one of a monoamide compound and an alcohol adduct thereof.

<4> The toner according to any one of <1> to <3> above, wherein the fatty acid amide compound is a linear fatty acid amide compound having a monovalent amide bond which compound is obtained by reacting ammonia with a linear fatty acid.

<5> The toner according to any one of <1> to <4> above, wherein the releasing agent is a hydrocarbon wax having a melting point of 60° C. or higher and lower than 90° C.

<6> The toner according to any one of <1> to <5> above, wherein the at least one polyester resin has an acid value of 5 mgKOH/g or higher and lower than 40 mgKOH/g.

<7> The toner according to any one of <1> to <6> above, wherein the at least one polyester resin has an acid value of 10 mgKOH/g or higher and lower than 30 mgKOH/g.

<8> The toner according to any one of <1> to <7> above, wherein the at least one polyester resin has a hydroxyl value of 5 mgKOH/g or higher and lower than 100 mgKOH/g.

<9> The toner according to any one of <1> to <8> above, wherein the at least one polyester resin has a hydroxyl value of 20 mgKOH/g or higher and lower than 60 mgKOH/g.

<10> The toner according to any one of <1> to <9> above, wherein the at least one polyester resin has a glass transition temperature Tg of 55° C. or higher and lower than 80° C.

<11> The toner according to any one of <1> to <10> above, wherein the toner satisfies the following expression Tgr–Tgr'>10° C., where Tgr denotes a glass transition temperature of the at least one polyester resin, and Tgr' denotes a glass transition temperature of a mixture of 90 parts by mass of the at least one polyester resin and 10 parts by mass of the fixing aid, which is measured after heating the mixture at 150° C.

<12> The toner according to any one of <1> to <11> above, wherein an amount of the fixing aid contained in the toner is 2% by mass or more and less than 25% by mass with respect to a total amount of the toner.

<13> The toner according to any one of <1> to <12> above, wherein the toner is produced in an aqueous medium.

<14> A developer including:

the toner according to any one of <1> to <13> above.

<15> A toner accommodating container including:

a container, and the toner according to any one of <1> to <13> above accommodated in the container.

<16> A process cartridge detachably mounted to an image forming apparatus main body, the process cartridge including:

a latent electrostatic image bearing member, and a developing unit configured to develop a latent electrostatic image on the latent electrostatic image bearing member with a toner to form a visible image, wherein the toner is the toner according to any one of <1> to <13> above.

<17> An image forming method including:

forming a latent electrostatic image on a latent electrostatic image bearing member, developing the latent electrostatic image with a toner to form a visible image, transferring the visible image onto a recording medium, and fixing the transferred image on the recording medium, wherein the toner is the toner according to any one of <1> to <13> above.

The present invention can provide a toner which is excellent in low-temperature fixing property and offset resistance, which does not contaminate a fixing device and/or an image, and which forms a sharp, high-quality image for a long period of time; a developer containing the toner; a toner accommodating container; a process cartridge; and an image forming method. These can solve the existing problems.

BEST MODE FOR CARRYING OUT THE INVENTION

Toner

Figure 1:
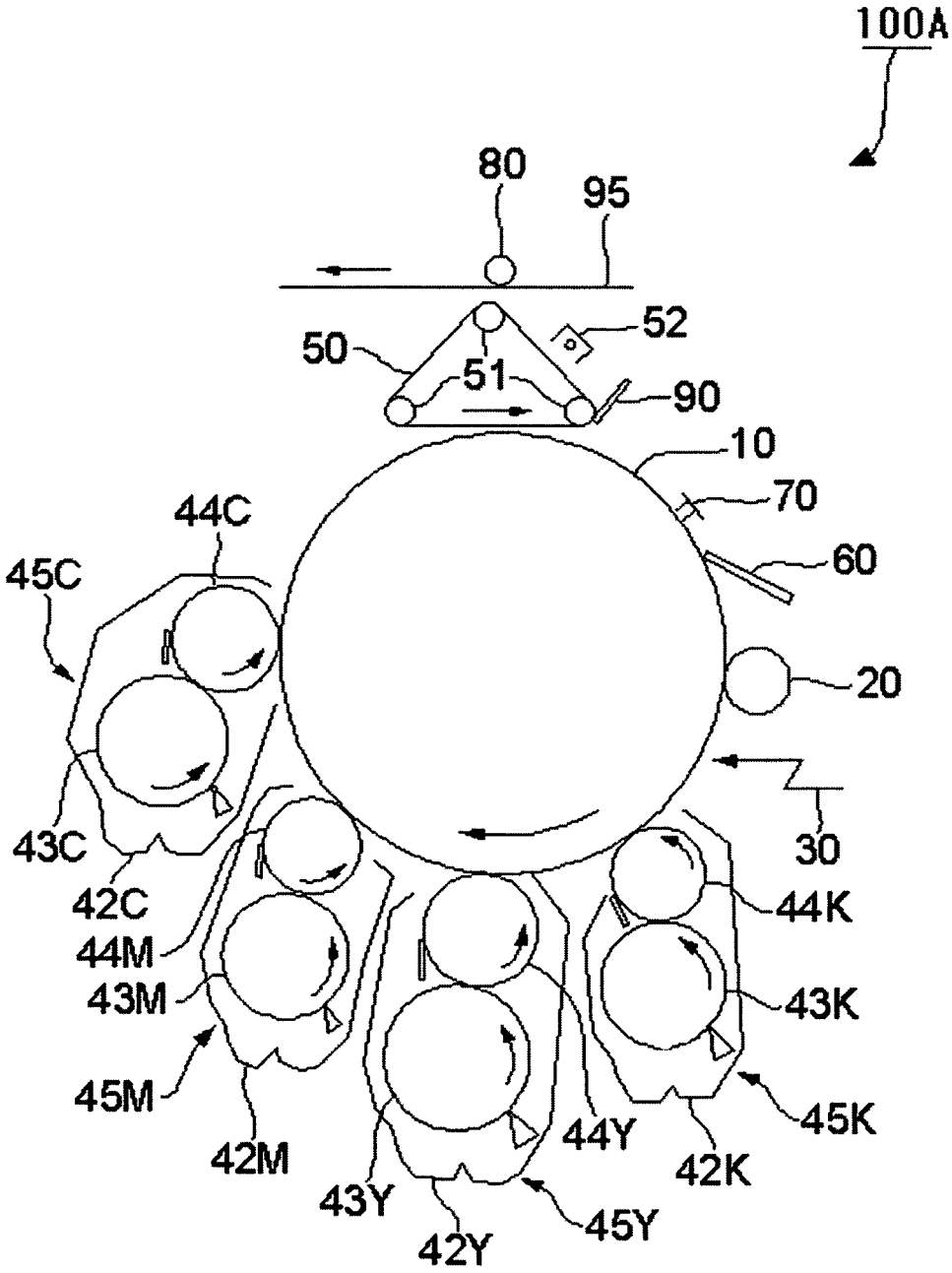
FIG. 1 exemplarily illustrates an image forming apparatus of the present invention.

A toner of the present invention contains a binder resin, a colorant, a releasing agent and a fixing aid; and, if necessary, further contains other components.

<Fixing Aid>

The fixing aid contains a fatty acid amide-based compound.

—Fatty Acid Amide-Based Compound—

The fatty acid amide-based compound is at least one of a fatty acid amide compound having a mono- or higher valent amide bond and a fatty acid amide-based compound having a mono- or higher valent amino group or a hydroxyl group.

The fatty acid amide-based compound is excellent in compatibility with resin which is a main component of the toner. It rapidly melts upon heating during fixation and more quickly softens the binder resin, improving the low-temperature fixing property of the toner.

Examples of the fatty acid amide-based compound include fatty acid amide compounds, monoamide compounds and fatty acid amide alcohol adducts (e.g., monoalcohol-added amide compounds and bisalcohol-added amide compounds). Among them, fatty acid amide compounds, monoamide compounds and alcohol adducts thereof are preferred, since they are more excellent in compatibility with resin, improve the low-temperature fixing property of the toner, and do not degrade heat resistance/storage stability thereof.

—Fatty Acid Amide Compound—

The fatty acid amide compound has the following structural formula (1) or (2).

$$R1\text{-}CO—NH—R2 \quad (1)$$

$$R1\text{-}CO—NH—CO—R2 \quad (2)$$

where R1 and R2 each represent a saturated hydrocarbon group having 10 to 30 carbon atoms or a monounsaturated or diunsaturated hydrocarbon group having 10 to 30 carbon atoms.

—Monoamide Compound—

The monoamide compound has the following structural formula (3).

$$R1\text{-}CONH_2 \quad (3)$$

where R1 represents a saturated hydrocarbon group having 10 to 30 carbon atoms or a monounsaturated or diunsaturated hydrocarbon group having 10 to 30 carbon atoms.

—Monoalcohol-Added Amide Compound—

The monoalcohol-added amide compound has the following structural formula (4).

Examples of the monoalcohol-added amide compound include alcohol adducts of the above monoamide compounds.

$$R1\text{-}NHCO—R2\text{-}OH \quad (4)$$

where R1 represents a saturated hydrocarbon group having 10 to 30 carbon atoms or a monounsaturated or diunsaturated hydrocarbon group having 10 to 30 carbon atoms, and R2 represents a saturated hydrocarbon group having 1 to 30 carbon atoms or a monounsaturated or diunsaturated hydrocarbon group having 1 to 30 carbon atoms.

—Bisalcohol-Added Amide Compound—

The bisalcohol-added amide compound has the following structural formula (5).

Examples of the bisalcohol-added amide compound include alcohols adducts of the above monoamide compounds.

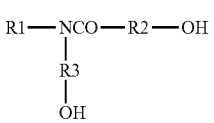

(5)

where R1 represents a saturated hydrocarbon group having 10 to 30 carbon atoms or a monounsaturated or diunsaturated hydrocarbon group having 10 to 30 carbon atoms, and each of R2 and R3 represents a saturated hydrocarbon group having 1 to 30 carbon atoms or a monounsaturated or diunsaturated hydrocarbon group having 1 to 30 carbon atoms.

The above monoamide compounds, the above monoalcohol-added amide compounds, and the above bisalcohol-added amide compounds have, at the ends of the fatty acid group(s) therein, an amino group (—$NH_2$) or a hydroxyl group(s) (—OH) each having high polarity and thus, are excellent in compatibility with resin which is a main component of the toner. They rapidly melt upon heating during fixation and more quickly soften the binder resin, improving the low-temperature fixing property of the toner. Of these, the monoamide compounds are preferred, since they are more excellent in compatibility with resin and more improve the low-temperature fixing property of the toner.

Meanwhile, the above fatty acid amide compounds have a polar group whose polarity is lower than that of an amino or hydroxyl group. But, they are sufficiently compatible with resin which is a main component of the toner. They rapidly melt upon heating during fixation and more quickly soften the binder resin, improving the low-temperature fixing property of the toner. In addition, the fatty acid amide compounds have a relatively high molecular weight among the fatty acid amide-based compounds and are excellent in toughness. Thus, when they are introduced into the toner, the formed toner is excellent in heat resistance/storage stability and anti-blocking property.

The melting point of the fatty acid amide-based compound is not particularly limited and may be appropriately determined depending on the purpose. It is preferably 70° C. or higher and lower than 120° C., more preferably 75° C. or higher and lower than 100° C., still more preferably 75° C. or higher and lower than 95° C. When the melting point is lower than 70° C., the formed toner may exhibit degraded heat resistance/storage stability. Whereas when the melting point is 120° C. or higher, the formed toner may not exhibit a sufficient low-temperature fixing property.

The fatty acid amide-based compound having a melting point of 70° C. or higher and lower than 120° C. is not particularly limited and may be appropriately selected depending on the purpose. Examples thereof include fatty acid amide compounds such as n-stearylstearic amide, n-behenylbehenic amide, n-palmitylpalmitic amide and n-stearylerucic amide each of which is produced from a C10 to C30 saturated or monounsaturated fatty acid(s) through amide formation; fatty acid bisamide compounds such as n-stearylstearic bisamide, n-behenylbehenic bisamide, n-palmitylpalmitic bisamide and n-stearylerucic bisamide each of which is produced from a C10 to C30 saturated or monounsaturated fatty acid(s) through amide formation; monoamide compounds such as palmitic amide, palmitoleic amide, stearic amide, oleic amide, arachidic amide, eicosenoic amide, behenic amide, erucic amide and lignoceric amide each of which is produced from a C10 to C30 saturated or monounsaturated fatty acid through monoamide formation; and fatty acid amide alcohol adducts such as palmitic acid monoethanol amide, stearic acid monoethanol amide, behenic acid monoethanol amide, lignoceric acid monoethanol amide, erucic acid monoethanol amide, palmitic acid monopropanol amide, stearic acid monopropanol amide, behenic acid monopropanol amide, lignoceric acid monopropanol amide, erucic acid monopropanol amide, palmitic acid bisethanol amide, stearic acid bisethanol amide, behenic acid bisethanol amide, lignoceric acid bisethanol amide, erucic acid bisethanol amide, palmitic acid bispropanol amide, stearic acid bispropanol amide, behenic acid bispropanol amide, lignoceric acid bispropanol amide, erucic acid bispropanol amide, ethanolamine distearate, ethanolamine dibehenate, ethanolamine dilignocerate, ethanolamine dierucate, propanolamine distearate, propanolamine dibehenate, propanolamine dilignocerate and propanolamine dierucate. These fatty acid amide compounds, fatty acid monoamide compounds, and alcohol adducts thereof are preferred, since they exhibit excellent compatibility with a resin and thus, improve the formed toner in low-temperature fixing property and do not impair heat resistance/storage stability of the formed toner. In addition, preferred is a linear fatty acid amide compound having a monovalent amide bond which compound is Obtained by reacting ammonia with a linear fatty acid, since it contains an amino group (—$NH_2$) with high polarity at an end of the linear fatty acid. This is because such a linear fatty acid amide compound that contains an amino group (—$NH_2$) with high polarity at an end of the linear fatty acid is excellent in compatibility with resin (i.e., a main component of toner), is increased in crystallinity, and has an excellent sharp-melt property, and thus, rapidly melts upon heating during fixation and more quickly softens the binder resin, improving the low-temperature fixing property of the toner.

Before heating of a toner with a fixing member, the fixing aid exists in the toner as crystalline domains independently from a binder resin. But, immediately after heating during fixation, it rapidly melts to be compatible with the binder resin and facilitates softening of it.

The fixing aid does not soften the binder resin before fixation and thus, the toner of the present invention is excellent in heat resistance/storage stability. Furthermore, during fixation, the fixing aid softens the binder resin and thus, the toner of the present invention is excellent in low-temperature fixing property.

Examples of methods for confirming that the fixing aid has crystallinity before toner fixation include a method in which whether or not the fixing aid is dissolved is judged as an index of its crystallinity based on its X-ray diffraction chart.

Specifically, using a crystal analysis X-ray diffraction apparatus (X'Pert MRDX'Pert MRD, product of Philips Co.), it can be confirmed that a fixing aid has crystallinity in a toner. First, only a fixing aid is brayed in a mortar to prepare sample powder. The thus-prepared sample powder is uniformly coated on a sample holder. Subsequently, the sample holder is set in the diffraction apparatus, following by measurement, to thereby give diffraction spectra of the fixing aid. Next, toner powder is coated on the holder, and then the holder is subjected to measurement similar to the above. Based on the diffraction spectra obtained in the case where only the fixing aid is used, the fixing aid contained in the toner can be identified. Also, in this diffraction apparatus, using a heating unit attached thereto, a change in diffraction spectra can be measured in accordance with a change in temperature. When X-ray diffraction spectra attributed to the fixing aid are measured at ambient temperature and 150° C. using the heating unit and then a change in peak area is determined between these temperatures, there can be measured the ratio of the amount of the fixing aid dissolved in the resin after heating to that of the fixing aid dissolved in the resin before heating. The greater a change in peak area attributed to the fixing aid between before heating and after heating, the more the degree of dissolution of the fixing aid in the toner resin through heating upon fixation. The toner contains the fixing aid whose change in peak area is large between before heating and after heating and thus, is excellent in low-temperature fixing property.

The diameter of the fixing aid in a dispersion state is not particularly limited and may be appropriately determined depending on the purpose. For example, it is preferably 10 nm to 3 μm, more preferably 50 nm to 1 μm, as the largest particle diameter. When the diameter is smaller than 10 nm, the fixing aid comes into contact with the binder resin in an increased surface area, potentially degrading heat resistance/storage stability of the formed toner. Whereas when the diameter is greater than 3 μm, the fixing aid is not sufficiently dissolved in the binder resin during heating upon fixation, potentially degrading a low-temperature fixing property of the formed toner.

The diameter of the fixing aid in a dispersion state can be measured, for example, as follows. Specifically, toner is embedded in an epoxy resin, and then the resultant product is sliced to a thickness of about 100 nm. The thus-obtained piece is stained with ruthenium tetroxide, and then is observed with a transmission electron microscope (TEM) at ×10,000, followed by photographing. The photograph is evaluated for dispersion state of the fixing aid. Notably, in order to distinguish the fixing aid from the releasing agent contained in the toner, the following is performed in advance. Specifically, the above procedure is repeated, except that the toner is changed to each of the fixing aid and the releasing agent, to thereby confirm the difference in contrast between the fixing aid and the releasing agent. When the above-confirmed difference in contrast is compared with the difference in contrast between the fixing aid and the releasing agent contained in the actually observed toner, the fixing aid can be distinguished from the releasing agent in the toner.

In the present invention, preferably, the expression $\Delta Tg = Tgr - Tgr' > 10°$ C. is satisfied, more preferably, the expression $\Delta Tg = Tgr - Tgr' > 15°$ C. is satisfied, where Tgr denotes a glass transition temperature of a polyester resin, and Tgr' denotes a glass transition temperature measured after heating at 150° C. a mixture of the polyester resin (90 parts by mass) and a fixing aid (10 parts by mass).

Notably, when two or more polyester resins are contained in the toner, at least one of them may satisfy the above expression.

Here, the glass transition temperature (Tgr) of a polyester resin and the glass transition temperature (Tgr') of a fixing aid (10 parts by mass)-containing polyester resin may be measured using a differential scanning calorimeter (DSC) system ("DSC-60", product of Shimadzu Corporation).

Specifically, the glass transition temperature (Tgr) of the polyester resin can be measured in accordance with the following procedure. First, the polyester resin (about 5.0 mg) is placed in a sample container made of aluminum; the sample container is placed on a holder unit; and the holder unit is set in an electric furnace. Using a differential scanning calorimeter ("DSC-60", product of Shimadzu Corporation), a DSC curve of the polyester resin is obtained by increasing or decreasing its temperature in a nitrogen atmosphere as follows. Specifically, it is heated from 20° C. to 150° C. at a temperature increasing rate of 10° C./min; it is cooled from 150° C. to 0° C. at a temperature decreasing rate of 10° C./min; and it is heated again to 150° C. at a temperature increasing rate of 10° C./min. Using the thus-obtained DSC curve and an analysis program of a DSC-60 system, the glass transition temperature (Tgr) of the polyester resin is calculated in a shoulder of the DSC curve corresponding to the second temperature increase.

Notably, when two or more polyester resins are contained in the toner, at least one of them may satisfy the above expression.

Similarly, the fixing aid (10 parts by mass)-containing polyester resin can be measured for glass transition temperature (Tgr'). First, a fixing aid (0.5 mg) and a polyester resin (4.5 mg) are placed in a sample container made of aluminum; the sample container is placed on a holder unit; and the holder unit is set in an electric furnace. Using a differential scanning calorimeter, a DSC curve of the mixture is obtained by increasing or decreasing its temperature in a nitrogen atmosphere as follows. Specifically, it is heated from 20° C. to 150° C. at a temperature increasing rate of 10° C./min; it is cooled from 150° C. to 0° C. at a temperature decreasing rate of 10° C./rain; and it is heated again to 150° C. at a temperature increasing rate of 10° C./rain. Using the thus-obtained DSC curve and an analysis program of a DSC-60 system, the glass transition temperature (Tgr') of the fixing aid-containing polyester resin is calculated in a shoulder of the DSC curve corresponding to the second temperature increase.

Notably, when two or more polyester resins are contained in the toner, at least one of them may satisfy the above expression.

The amount of the fixing aid contained in the toner is not particularly limited and may be appropriately determined depending on the purpose. It is preferably 2% by mass or more and less than 25% by mass, more preferably 3% by mass to 20% by mass, on the basis of the total amount of the toner. When the amount is less than 2% by mass, the fixing aid does not sufficiently exhibit its effects, potentially leading to a poor low-temperature fixing property of the formed toner. Whereas when the amount is 25% by mass or more, the formed toner may exhibit a poor offset resistance and a poor heat resistance/storage stability.

<Binder Resin>

The binder resin contains a polyester resin.

—Polyester Resin—

The polyester resin is not particularly limited and may be appropriately selected depending on the purpose.

The polyester resin is formed through dehydration condensation between a polyhydric alcohol and a polycarboxylic acid.

Examples of the polyhydric alcohol include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A; and dihydric alcohols formed by adding, to bisphenol A, a cyclic ether (e.g., ethylene oxide or propylene oxide).

Also, alcohols having three or more hydroxyl groups are preferably used for crosslinking the polyester resin. Examples of the alcohols having three or more hydroxyl groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

Examples of the polycarboxylic acid include benzenedicarboxylic acids (e.g., phthalic acid, isophthalic acid and terephthalic acid) and anhydrides thereof; alkyldicarboxylic acids (e.g., succinic acid, adipic acid, sebacic acid and azelaic acid) and anhydrides thereof; unsaturated dibasic acids (e.g., maleic acid, citraconic acid, itaconic acid, alkenylsuccinic acid, fumaric acid and mesaconic acid); unsaturated dibasic acid anhydrides (e.g., maleic anhydride, citraconic anhydride, itaconic anhydride and alkenylsuccinic anhydride); trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-haxanetricarboxylic acid, 1,3-dicarboxyl-2-methyl-2-methylenecarboxypropane, tetrakis(methylenecarboxy)methane, 1,2,7,8-octanetetracarboxylic acid, Enpol trimer acid; anhydrides thereof; and partial alkyl esters of thereof.

The acid value of the polyester resin is not particularly limited and may be appropriately determined depending on the purpose. It is preferably 5 mgKOH/g or higher and lower than 40 mgKOH/g, more preferably 10 mgKOH/g or higher and lower than 30 mgKOH/g. When the acid value is lower than 5 mgKOH/g, the polyester resin exhibits a reduced affinity for paper; i.e., a commonly used recording medium, potentially degrading a low-temperature fixing property of the toner. In addition, the toner is difficult to negatively charge, which may degrade the formed image. Furthermore, when the acid value is lower than 5 mgKOH/g, the polyester resin may be poorly compatible with a fatty acid amide-based compound serving as a fixing aid, resulting in that the toner may not exhibit a sufficient low-temperature fixing property. Whereas when the acid value is 40 mgKOH/g or higher, the toner tends to be affected by environmental factors, for example, under high-temperature, high-humidity conditions or low-temperature, low-humidity conditions, potentially leading to image failure.

Notably, when two or more polyester resins are contained in the toner, at least one of them may meet the above requirements; i.e., may have an acid value falling within the above range.

The hydroxyl value of the polyester resin is not particularly limited and may be appropriately determined depending on the purpose. It is preferably 5 mgKOH/g or higher and lower than 100 mgKOH/g, more preferably 20 mgKOH/g or higher and lower than 60 mgKOH/g. When the hydroxyl value is lower than 5 mgKOH/g, the polyester resin exhibits a reduced affinity for paper; i.e., a commonly used recording medium, potentially degrading a low-temperature fixing property of the toner. In addition, the toner is difficult to negatively charge, which may degrade the formed image. Furthermore, when the hydroxyl value is lower than 5 mgKOH/g, the polyester resin may be poorly compatible with a fatty acid amide-based compound serving as a fixing aid, resulting in that the toner may not exhibit a sufficient low-temperature fixing property. Whereas when the hydroxyl value is 100 mgKOH/g or higher, the toner tends to be affected by environmental factors, for example, under high-temperature, high-humidity conditions or low-temperature, low-humidity conditions, potentially leading to image failure.

Notably, when two or more polyester resins are contained in the toner, at least one of them may meet the above requirements; i.e., may have a hydroxyl value falling within the above range.

THF soluble matter of the polyester resin preferably has such a molecular weight distribution that at least one peak exists in a range of M.W. 3,000 to M.W. 50,000, since the formed toner has a desired fixing property and an offset resistance. More preferably, it has such a molecular weight distribution that at least one peak exists in a range of M.W. 5,000 to M.W. 20,000. In addition, THF soluble matter of the polyester resin preferably contains a component having a molecular weight of 100,000 or lower in an amount of 60% by mass to 100% by mass.

Here, the molecular weight distribution of the polyester resin is measured through gel permeation chromatography (GPC) using THF as a solvent.

The glass transition temperature (Tg) of the polyester resin is preferably 55° C. or higher and lower than 80° C., more preferably 60° C. or higher and lower than 75° C., from the viewpoint of attaining desired toner storage stability. When the Tg is 55° C. or higher and lower than 80° C., the formed toner is excellent in stability during storage at high temperature. In addition, the binder resin is sufficiently softened by the fixing aid, and thus contributes greatly to production of a toner excellent in low-temperature fixing property.

The binder resin may further contain a resin other than the polyester resin. Examples thereof include homopolymers or copolymers formed of, for example, styrene monomers, acrylic monomers and/or methacrylic monomers; polyol resins; phenol resins; silicone resins; polyurethane resins; polyamide resins; furan resins; epoxy resins; xylene resins; terpene resin; coumarone-indene resins; polycarbonate resins; and petroleum resins. These resins may be used alone or in combination.

<Releasing Agent>

The releasing agent is not particularly limited and may be appropriately selected depending on the purpose. The melting point thereof is preferably low; i.e., 60° C. or higher and lower than 90° C. When dispersed together with the above resins, such a low-melting-point releasing agent effectively exhibits its releasing effects on the interface between a fixing roller and each toner particle. Thus, even when an oil-less mechanism is employed (in which a releasing agent such as oil is not applied onto a fixing roller), good hot offset resistance is attained.

In particular, the toner of the present invention contains a fixing aid and thus exhibits an excellent low-temperature fixing property. The toner, therefore, is thought to be fixed with a fixing roller whose temperature is set to be lower than that of a conventionally used fixing roller. Thus, the releasing agent preferably exhibits its releasing effects at lower temperature. For this reason, a releasing agent having a melting point lower than 90° C. is preferably used. Also, when the melting point of the releasing agent is lower than 60° C., toner storage stability may be poor at high temperature, potentially leading to image failure.

Examples of the releasing agent include natural waxes such as vegetable waxes (e.g., carnauba wax, cotton wax, Japan wax and rice wax), animal waxes (e.g., bees wax and lanolin), mineral waxes (e.g., ozokelite and ceresine) and petroleum waxes (e.g., paraffin waxes, microcrystalline waxes and petrolatum); synthetic hydrocarbon waxes (e.g., Fischer-Tropsch waxes, polyethylene waxes and polypropylene waxes); and synthetic waxes (e.g., ester waxes, ketone waxes and ether waxes). Further examples include fatty acid amide-based compounds such as 12-hydroxystearic acid amide, stearic amide, phthalic anhydride imide and chlorinated hydrocarbons; low-molecular-weight crystalline polymer resins such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain. Among them, hydrocarbon waxes such as paraffin waxes, polyethylene waxes and polypropylene waxes are preferred, since they impart a sufficient low-temperature fixing property to the formed toner. This is because these waxes are poorly compatible with the fatty acid amide-based compound serving as a fixing aid and thus, these components (the waxes and the fatty acid amide component) independently exhibit their effects without mutually degrading their functions.

These releasing agents may be used alone or in combination.

The amount of the releasing agent contained in the toner is not particularly limited and may be appropriately determined depending on the purpose. It is preferably 1% by mass to 30% by mass on the basis of the total amount of the toner. When the amount is less than 1% by mass on the basis of the total amount of the toner, the formed toner may exhibit a poor offset resistance. Whereas when the amount is more than 30% by mass on the basis of the total amount of the toner, the formed toner may involve considerable filming, and fogging may occur in the formed image.

(Colorant)

The colorant may be appropriately selected depending on the purpose from known dyes and pigments. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone.

These colorants may be used alone or in combination.

The amount of the colorant contained in the toner is not particularly limited and may be appropriately determined depending on the purpose. It is preferably 1% by mass to 15% by mass, more preferably 3% by mass to 10% by mass, on the basis of the total amount of the toner. When the amount is less than 1% by mass, the formed toner may degrade in coloring performance. Whereas when the amount is more than 15% by mass, the pigment is not sufficiently dispersed in the toner, potentially leading to a drop in coloring performance and degradation in electrical characteristics of the formed toner.

The colorant may be mixed with a resin to form a masterbatch. Examples of the resin include polyesters, polymers of a substituted or unsubstituted styrene, styrene copolymers, polymethyl methacrylates, polybutyl methacrylates, polyvinyl chlorides, polyvinyl acetates, polyethylenes, polypropylenes, epoxy resins, epoxy polyol resins, polyurethanes, polyamides, polyvinyl butyrals, polyacrylic acid resins, rosin, modified rosins, terpene resins, aliphatic or alicyclic hydrocarbon resins, aromatic petroleum resins, chlorinated paraffins and paraffin waxes.

These resins may be used alone or in combination.

Examples of the polymers of a substituted or unsubstituted styrene include polystyrenes, poly(p-chlorostyrenes) and polyvinyltoluenes.

Examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The masterbatch can be prepared by mixing or kneading a colorant with a resin through application of high shearing force. Preferably, an organic solvent may be used for improving mixing of these materials. Further, a so-called flashing method is preferably used, since a wet cake of the colorant can be directly used (i.e., no drying is required). Here, the flashing method is a method in which an aqueous paste containing a colorant is mixed or kneaded with a resin and an organic solvent, and then the colorant is transferred to the resin to remove the water and the organic solvent. In this mixing/kneading, for example, a high-shearing disperser (e.g., a three-roll mill) may be used.

<Other Components>

Examples of the other components contained in the toner include a charge controlling agent, inorganic microparticles, a cleaning performance improver and a magnetic material.

Examples of the charge controlling agent include nigrosine dyes, triphenylmethane dyes, chrome-containing metal complex dyes, molybdenum acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based surfactants, metal salts of salicylic acid, and metal salts of salicylic acid derivatives.

Also, the charge controlling agent may be a commercially available product, and examples thereof include BONTRON 03 (nigrosine dye), BONTRON P-51 (quaternary ammonium salt), BONTRON S-34 (metal azo-containing dye), E-82 (oxynaphthoic acid-based metal complex), E-84 (salicylic acid-based metal complex) and E-89 (phenol condensate) (these products are of Orient Chemical Industries, Ltd.); TP-302 and TP-415 (quaternary ammonium salt molybdenum complex (these products are of Hodogaya Chemical Co.); COPY CHARGE PSY VP 2038 (quaternary ammonium salt), COPY BLUE PR (triphenylmethane derivative), COPY CHARGE NEG VP2036 (quaternary ammonium salt) and COPY CHARGE NX VP434 (these products are of Hoechst AG); LRA-901 and LR-147 (boron complex) (these products are of Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

These charge control agents may be used alone or in combination.

The amount of the charge controlling agent added to the toner is not particularly limited and may be appropriately determined depending on the purpose. For example, the amount is preferably 0.1% by mass to 10% by mass, more preferably 0.2% by mass to 5% by mass, on the basis of the amount of the binder resin. When the amount is less than 0.1% by mass, the charge controlling agent may not exhibit its intrinsic effects. Whereas when the amount is more than 10% by mass, the formed toner has too high chargeability, resulting in that the charge controlling agent cannot sufficiently exhibit its effects. As a result, the electrostatic force increases between the developing roller and the toner, potentially decreasing the fluidity of the toner or forming an image with reduced color density.

The inorganic microparticles are used as an external additive for imparting, for example, fluidity, developability and chargeability to the toner. Examples of the inorganic microparticles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride.

These inorganic microparticles may be used alone or in combination.

The primary particle diameter of the inorganic microparticles is preferably 5 nm to 2 μm, more preferably 5 nm to 500 nm.

The amount of the inorganic microparticles contained in the toner is preferably 0.01% by mass to 5.0% by mass, more preferably 0.01% by mass to 2.0% by mass, on the basis of the total amount of the toner.

Also, the inorganic microparticles are preferably subjected to a surface treatment using a flowability improver. The thus-treated inorganic microparticles have improved hydrophobicity and thus, contribute to prevention of degradation in flowability and/or chargeability even under high-humidity conditions.

Examples of the flowability improver include silane coupling agents, silylating agents, fluorinated alkyl group-containing silane coupling agents, organic titanate-based coupling agents, aluminum-based coupling agents, silicone oil and modified silicone oil. When silica and titanium oxide are used, preferably, they are subjected to a surface treatment using the flowability improver and used as hydrophobic silica and hydrophobic titanium oxide.

The cleaning performance improver is used for the purpose of easily removing toner particles remaining after transfer on a photoconductor and a primary transfer medium.

Examples of the cleaning performance improver include fatty acid metal salts (e.g., zinc stearate and calcium stearate) and polymer microparticles produced through soap-free emulsification polymerization (e.g., polymethyl methacrylate microparticls and polystyrene microparticles). Preferably, the polymer microparticles have a relatively narrow particle size distribution and a volume average particle diameter of 0.01 μm to 1 μm.

Examples of the magnetic material include iron powder, magnetite and ferrite. Note that the magnetic material is preferably white in consideration of the color tone of the formed toner.

The toner of the present invention is excellent in low-temperature fixing property and offset resistance, and can form a high-quality image for a long period of time. Thus, the toner of the present invention may be used in various fields. In particular, it is preferably used for image formation based on electrophotography.

<Production Method for Toner (Toner Production Method)>

The toner production method is not particularly limited and may be appropriately selected depending on the purpose from conventionally known toner production methods. Examples thereof include kneading-pulverizing methods, polymerization methods, dissolution suspension methods and spray granulation methods. Of these, dissolution suspension methods and polymerization methods are particularly preferred, since they employ an aqueous medium where the fixing aid and the polyester resin are difficult to be compatible with each other during toner production.

—Kneading-Pulverizing Method—

One of the kneading-pulverizing methods is a method in which a toner material containing at least a binder resin, a colorant, a releasing agent and a fixing aid is melt-kneaded, and then the thus-kneaded product is pulverized and classified to produce toner base particles.

In this melt-kneading, the toner material is mixed and then the resultant mixture is melt-kneaded with a melt kneader. Examples of the melt kneader include uniaxial or biaxial continuous kneaders and batch kneaders using a roll mill.

Preferred examples thereof include a KTK-type biaxial extruder (product of KOBE STEEL. Ltd.), a TEM-type extruder (product of TOSHIBA MACHINE CO., LTD.), a biaxial extruder (product of KCK Co., Ltd.), a PCM-type biaxial extruder (product of IKEGAI LTD.) and a co-kneader (product of BUSS Company). Preferably, the melt-kneading is performed under appropriate conditions so as not to cleave the molecular chains of the binder resin. The temperature during melt-kneading is determined in consideration of the softening point of the binder resin. Specifically, when the temperature is much higher than the softening point, cleavage of the molecular chains occurs to a considerable extent; whereas when the temperature is much lower than the softening point, a sufficient dispersion state is difficult to attain.

The thus-kneaded product is pulverized to form particles. In this pulverization, the kneaded product is roughly pulverized and then finely pulverized. Preferred examples of pulverizing methods include a method in which the kneaded product is crushed against a collision plate under a jet stream for pulverization, a method in which the kneaded particles are crushed one another under a jet stream for pulverization, and a method in which the kneaded product is pulverized by passage through the narrow gap between a mechanically rotating rotor and a stator.

The thus-pulverized product is classified to prepare particles having a predetermined particle diameter. This classification is performed by removing microparticles with a cyclone, a decanter, a centrifugal separator, etc.

After completion of the above pulverization and classification, the obtained pulverized product is classified in a gas flow by the action of centrifugal force, whereby toner base particles having a predetermined particle diameter can be produced.

Subsequently, an external additive is added to the toner base particles. Specifically, the toner particles and the external additive are mixed with each other under stirring using a mixer, whereby the toner particles are covered with pulverized products of the external additive. In this treatment, in terms of durability of the formed toner, it is important that an external additive (e.g., inorganic microparticles or resin microparticles) is made to adhere to toner base particles uniformly and firmly.

—Polymerization Method—

In the toner production method based on the polymerization method, for example, a toner material containing at least a modified polyester resin capable of forming a urea or urethane bond, a colorant, a releasing agent and a fixing aid is dissolved or dispersed in an organic solvent; the resultant solution or dispersion is dispersed in an aqueous medium, followed by polyaddition reaction; and the solvent of the obtained dispersion is removed, followed by washing.

Examples of the modified polyester resin capable of forming a urea or urethane bond include isocyanate group-containing polyester prepolymer (A) which is produced through reaction between a polyisocyanate (PIC) compound and a terminal carboxyl or hydroxyl group of polyester. And, a modified polyester resin whose molecular chain has been crosslinked/elongated through reaction between the polyester prepolymer and amine (B) provides a toner excellent in both low-temperature fixing property and hot-offset resistance.

Examples of the polyisocyanate (PIC) compound include aliphatic polyisocyanates (e.g., tetramethylene diisocyanate, hexamethylene diisocyanate and 2,6-diisocyanatomethylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aroma-aliphatic diisocyanates (e.g., α, α, α', α'-tetramethylxylylene diisocyanate); and isocyanates. In addition, there can be used products obtained by blocking the above-listed polyisocyanates with a phenol derivative, an oxime, a caprolactam, etc. These polyisocyante compounds may be used alone or in combination.

The ratio of polyisocyanate (PIC) to hydroxyl group-containing polyester is 5/1 to 1/1, preferably 4/1 to 1.2/1, more preferably 2.5/1 to 1.5/1, in terms of the equivalent ratio [NCO]/[OH] of isocyanate group [NCO] to hydroxyl group [OH].

The polyester prepolymer (A) preferably has, in one molecule thereof, one or more isocyanate groups, more preferably 1.5 groups to 3 groups on average, still more preferably 1.8 groups to 2.5 groups on average.

Examples of the amine (B) which is reacted with the polyester prepolymer include divalent amine compounds (B1), tri- or more-valent amine compounds (B2), amino alcohols (B3), aminomercaptans (B4), amino acids (B5), and amino-blocked products (B6) of the amines (B1) to (B5).

Examples of the divalent amine compounds (B1) include aromatic diamines (e.g., phenylenediamine, diethyltoluenediamine and 4,4'-diaminodiphenylmethane); alicyclic diamines (e.g., 4,4'-diamino-3,3'-dimethyldicyclohexylmethane, diaminecyclohexane and isophoronediamine); and aliphatic diamines (e.g., ethylenediamine, tetramethylenediamine and hexamethylenediamine).

Examples of the tri- or more-valent amine compounds (B2) include diethylenetriamine and triethylenetetramine.

Examples of the amino alcohol (B3) include ethanolamine and hydroxyethylaniline.

Examples of the aminomercaptan (B4) include aminoethyl mercaptan and aminopropyl mercaptan.

Examples of the amino acid (B5) include aminopropionic acid and aminocaproic acid.

Examples of the amino-blocked product (B6) include ketimine compounds and oxazolidine compounds derived from the amines (B1) to (B5) and ketones (e.g., acetone, methyl ethyl ketone and methyl isobutyl ketone). Among these amines (B), the divalent amine compound (B1) is particularly preferred. Also, particularly preferred is a mixture of the diamine (B1) and a small amount of the tri- or more-valent amine compound (B2).

The ratio of isocyanate group-containing polyester prepolymer (A) to amine (B) is preferably 1/2 to 2/1, more preferably 1.5/1 to 1/1.5, still more preferably 1.2/1 to 1/1.2, in terms of the equivalent ratio [NCO]/[NHx] of isocyanate group [NCO] to amino group [NHx].

The toner production method based on the above-described polymerization method can produce spherical toner particles having a small particle diameter at low costs with less environmental load.

(Developer)

The Developer of the Present Invention Contains the Toner of the present invention, and may further contain other components such as a carrier. It may be, for example, a one-component developer containing only a toner, or a two-component developer containing a toner and a carrier. When used in, for example, high-speed printers which respond to increase in the recent information processing speed, it is preferably used as a two-component developer from the viewpoint of elongating its service life. Such a developer may be used for various known electrophotographies based on, for example, a magnetic one-component developing method, a non-magnetic one-component developing method or a two-component developing method.

When used as a one-component developer, the developer of the present invention involves less change in diameter of each toner particle even after repetitive cycles of consumption and addition thereof, which prevents toner filming on a developing roller and toner adhesion on surrounding members such as a blade for forming a thin toner layer. Thus, even when used (stirred) in a developing device for a long period of time, the developer maintains stable, excellent developability.

Also, when used as a two-component developer, the developer of the present invention involves less change in diameter of each toner particle even after long-term repetitive cycles of consumption and addition thereof. Thus, even when stirred in a developing device for a long period of time, the developer maintains stable, excellent develop ability.

In the two-component developer, the carrier content is preferably 90% by mass to 98% by mass, more preferably 93% by mass to 97% by mass, on the basis of the total amount of the two-component developer.

The carrier is not particularly limited, and preferably has a core and a resin layer covering the core.

Examples of the material for the core include manganese-strontium (Mn—Sr)-based materials (50 emu/g to 90 emu/g) and manganese-magnesium (Mn—Mg)-based materials (50 emu/g to 90 emu/g). These may be used alone or in combination. Notably, from the viewpoint of ensuring desired image density, strongly magnetized materials (e.g., iron powder (100 emu/g or higher) and magnetite (75 emu/g to 120 emu/g)) are preferably used as the core. Meanwhile, from the viewpoint of advantageously attaining high image quality and weakening impact on a photoconductor on which surface toner particles are retained in the chain-like form, weakly magnetized materials (e.g., copper-zinc (Cu—Zn)-based materials (30 emu/g to 80 emu/g)) are preferably used as the core.

The core preferably has a volume average particle diameter (D50) of 10 μm to 150 μm, more preferably 20 μm to 80 μm. When the D50 is smaller than 10 μm, the carrier has a particle size distribution most of which correspond to fine powder. Thus, magnetization per particle decreases, potentially causing carrier scattering. Whereas when the D50 is greater than 150 μm, the specific surface area of the carrier decreases, potentially causing toner scattering. As a result, in the case of full color images having a large solid portion, reproducibility may degrade in, among others, the solid portion.

Examples of the material for the resin layer include amino-based resins, polyvinyl-based resins, polystyrene-based resins, halogenated olefin resins, polyester-based resins, polycarbonate-based resins, polyethylene resins, polyvinyl fluoride resins, polyvinylidene fluoride resins, polytrifluoroethylene resins, polyhexafluoropropylene resins, copolymers formed of vinylidene fluoride and an acrylic monomer, copolymers formed of vinylidene fluoride and vinyl fluoride, fluoroterpolmers such as terpolymers formed of tetrafluoroethylene, vinylidene fluoride and a non-fluorinated monomer, and silicone resins. These may be used alone or in combination.

Examples of the amino-based resins include urea-formaldehyde resins, melamine resins, benzoguanamine resins, urea resins, polyamide resins and epoxy resins.

Examples of the polyvinyl-based resins include acrylic resins, polymethyl mathacrylate, polyacrylonitrile, polyvinyl acetate, polyvinyl alcohol and polyvinyl butyral.

Examples of the polystyrene-based resins include polystyrene and styrene-acrylic copolymers.

Examples of the halogenated olefin resins include polyvinyl chloride.

Examples of the polyester resins include polyethylene terephthalate and polybutylene terephthalate.

If necessary, the resin layer may further contain, for example, conductive powder. Examples of the material for the conductive powder include metals, carbon black, titanium oxide, tin oxide and zinc oxide. The average particle diameter of the conductive powder is not particularly limited and is preferably 1 μm or smaller. When the average particle diameter is in excess of 1 μm, electrical resistance may be difficult to control.

The resin layer may be formed, for example, as follows. Specifically, a silicone resin, etc. are dissolved in a solvent to prepare a coating liquid, and then the thus-prepared coating liquid is applied onto the core surface with a known coating method, followed by drying and baking. Examples of the coating method include immersion methods, spray methods and brush coating methods. Examples of the solvent include toluene, xylene, methyl ethyl ketone, methyl isobutyl ketone and cellosolve acetate. The baking method may be an external or internal heating method. Examples thereof include methods employing a fixed-type electric furnace, a fluid-type electric furnace, a rotary electric furnace or a burner furnace; and methods employing microwave radiation.

The amount of the resin layer contained in the carrier is preferably 0.01% by mass to 5.0% by mass on the basis of the total amount of the carrier. When the amount is less than 0.01% by mass, a uniform resin layer may not be formed on the surface of a carrier. Whereas when the amount is more than 5.0% by mass, the formed resin layer becomes too thick to cause adhesion between carrier particles, potentially resulting in failure to form uniform carrier particles.

The developer of the present invention may be suitably used in image formation by various known electrophotographies based on, for example, a magnetic one-component developing method, a non-magnetic one-component developing method or a two-component developing method.

<Toner Accommodating Container>

The toner accommodating container of the present invention accommodates the toner of the present invention. The container is not particularly limited and may be appropriately selected from known containers. Examples thereof include those having a cap and a container main body.

The size, shape, structure and material of the container main body are not particularly limited. The container main body preferably has, for example, a hollow-cylindrical shape. Particularly preferably, it is a hollow-cylindrical body whose inner surface has spirally-arranged concavo-convex portions some or all of which can accordion and in which a developer accommodated can be transferred to an outlet port through rotation. The material therefor is not particularly limited and is preferably those from which the container main body can be formed with high dimensional accuracy. Among them, preferred are polyester resins, polyethylene resins, polypropylene resins, polystyrene resins, polyvinyl chloride resins, polyacrylic acids, polycarbonate resins, ABS resins, polyacetal resins, etc.

This toner accommodating container has excellent handleability; i.e., is suitable for storage, transportation, etc. and is suitably used for supply of a developer with being detachably mounted to the below-described process cartridge, image forming apparatus, etc.

(Image Forming Method and Image Forming Apparatus)

The image forming method of the present invention preferably includes a latent electrostatic image forming step, a developing step, a transfer step and a fixing step. More preferably, it further includes a cleaning step. If necessary, it may further include a charge-eliminating step, a recycling step and a controlling step.

An image forming apparatus used in the present invention preferably includes a latent electrostatic image bearing member, a latent electrostatic image forming unit, a developing unit, a transfer unit and a fixing unit. More preferably, it further includes a cleaning unit. If necessary, it may further include a charge-eliminating unit, a recycling unit and a controlling unit.

The image forming method of the present invention can be performed by the image forming apparatus of the present invention; the latent electrostatic image forming step can be performed by the latent electrostatic image forming unit; the developing step can be performed by the developing unit; the transfer step can be performed by the transfer unit; the fixing step can be performed by the fixing unit; and the other steps can be performed by the other units.

The latent electrostatic image forming step is a step of forming a latent electrostatic image on a latent electrostatic image bearing member such as a photoconductive insulator or a photoconductor. In the latent electrostatic image bearing member, its material, shape, structure, size, etc. are not particularly limited and can be appropriately selected from those known in the art. It preferably has a drum shape. Also, the photoconductor is made, for example, of inorganic photoconductor materials (e.g., amorphous silicon and serene) and organic photoconductor materials (e.g., polysilane and phthalopolymethine). Among them, amorphous silicon photoconductors, etc. are preferably used in terms of attaining a long service life.

The latent electrostatic image can be formed by the latent electrostatic image forming unit, for example, as follows: a surface of the latent electrostatic image bearing member is uniformly charged and then imagewise exposed. The latent electrostatic image forming unit includes a charging device for uniformly charging the surface of the latent electrostatic image bearing member, and an exposing device for imagewise exposing the surface of the latent electrostatic image bearing member.

The charging device is not particularly limited, and examples thereof include known contact charging devices having a conductive or semi-conductive roller, brush, film, or rubber blade, and non-contact charging devices employing corona discharge (e.g., a corotron and a scorotron).

The exposing device is not particularly limited, so long as an imagewise exposed image of interest can be formed on the latent electrostatic image bearing member surface which has been charged by the charging device. Examples thereof include various exposing devices such as copy optical systems, rod lens array systems, laser optical systems and liquid crystal shutter optical systems. Notably, exposure may be performed by imagewise exposing the latent electrostatic image bearing member from the backside thereof.

The developing step is a step of developing the latent electrostatic image using the toner of the present invention to form a visible image with a developing unit. The developing unit is not particularly limited, so long as development can be performed using, for example, the toner of the present invention. Preferred examples thereof include developing devices having a developer accommodating container capable of employing a member having at least a developing device which accommodates the developer of the present invention and which can apply the toner to the latent electrostatic image in a contact or non-contact manner. The developing device may employ a dry or wet developing method, or may be a monochromatic or multicolor developing device. Examples thereof include those having a stirrer frictionally charging the developer of the present invention and a rotatable magnetic roller. In the developing device, the toner and carrier are stirred so that the toner is charged by friction generated therebetween. The charged toner is retained in the chain-like form on the surface of the rotating magnetic roller to form a magnetic brush. The magnetic roller is disposed in the vicinity of the latent electrostatic image bearing member and thus, some of the toner forming the magnetic brush are electrically adsorbed onto a surface of the latent electrostatic image bearing member. As a result, the electrostatic latent image is developed with the toner to form a toner image on the surface of the latent electrostatic image bearing member. The developing device accommodates the developer of the present invention, and the developer may be a one-component developer or a two-component developer.

The transfer step is a step of transferring the toner image onto a recording medium by charging, using a transfer charging device, the latent electrostatic image bearing member on which the toner image has been formed, and can be performed by a transfer unit. Preferably, the transfer step includes a primary transfer step in which a toner image is transferred onto an intermediate transfer member, and a secondary transfer step in which the toner image transferred onto the intermediate transfer member is transferred onto a recording medium. Also, toners of two or more colors are preferably used (a full color toner is more preferably used). Thus, more preferably, the transfer step includes a primary transfer step for transferring each toner image onto an intermediate member to form a composite toner image; and a secondary transfer step for transferring the composite toner image onto a recording medium.

Preferably, the transfer unit includes a primary transfer unit for transferring toner images onto an intermediate member to form a composite transfer image; and a secondary transfer unit for transferring the composite toner image onto a recording medium. The intermediate transfer member is not particularly limited, and examples thereof include endless transfer belts. The transfer unit (primary and secondary transfer units) preferably includes a transfer device which electrically transfers toner images from a latent electrostatic image bearing member onto a recording medium. The transfer unit may include one or more transfer devices.

Examples of the transfer device include a corona transfer device employing corona discharge, a transfer belt, a transfer roller, a press transfer roller and an adhesive transfer device.

The recording medium is not particularly limited and may be appropriately selected from known recording media (recording paper) depending on the purpose.

The fixing step is a step of fixing, using a fixing unit, the toner image which has been transferred onto the recording medium. When two or more color toners are used, it may be performed every after an image formed by each color toner is transferred onto the recording medium; or may be performed at one time after images formed by all color toners are superposed on the recording medium. The fixing unit is not particularly limited and may be a known heat-pressing device. Examples of the heat-pressing device include a combination of a heating roller and a pressing roller; and a combination of a heating roller, a pressing roller and an endless belt. The heating temperature in the heating-pressing unit is generally 80° C. to 200° C. If necessary, a known photo-fixing device, etc. is used together with or instead of the fixing unit depending on the purpose.

The charge-eliminating step is a step of eliminating charges by applying a charge-eliminating bias to the latent electrostatic image bearing member, and can be preferably performed by the charge-eliminating unit. The charge-eliminating unit is not particularly limited, so long as it can apply a charge-eliminating bias to the latent electrostatic image bearing member, and may be, for example, a charge-eliminating lamp.

The cleaning step is a step of removing the toner remaining on the latent electrostatic image bearing member, and can be performed by a cleaning unit. The cleaning unit is not particularly limited, so long as it can remove the toner remaining on the latent electrostatic image bearing member, and may be, for example, a magnetic blush cleaner, an electrostatic brush cleaner, a magnetic roller cleaner, a blade cleaner, a brush cleaner or a web cleaner.

The recycling step is a step of recycling the toner removed in the cleaning step to the developing unit, and can be performed by the recycling unit. The recycling unit is not particularly limited and may be, for example, a known conveying unit.

The controlling step is a step of controlling each of the above steps, and can be performed by the controlling unit. The controlling unit is not particularly limited, so long as it can control the operation of each unit, and may be, for example, a sequencer or a computer.

FIG. 1 exemplarily shows an image forming apparatus of the present invention. An image forming apparatus 100A includes a photoconductor drum 10 serving as the latent electrostatic image bearing member, a charging roller 20 serving as the charging unit, an exposing device (not illustrated) serving as the exposing unit, a developing devices serving as the developing unit (i.e., a black toner-developing device 45K, a yellow-toner developing device 45Y, a magenta-toner developing device 45M, and a cyan-toner developing device 45C), an intermediate transfer member 50, a cleaning device 60 having a cleaning blade and serving as the cleaning unit, and a charge-eliminating lamp 70 serving as the charge-eliminating unit.

The intermediate transfer member 50 is an endless belt and can be driven in a direction indicated by an arrow using three support rollers 51 which are provided in a loop of the belt. Some of the three support rollers 51 serve also as a transfer bias roller capable of applying a predetermined transfer bias (primary transfer bias) to the intermediate transfer member 50.

A cleaning device 90 having a cleaning blade is disposed in the vicinity of the intermediate transfer member 50. Also, a transfer roller 80 is disposed so as to face the intermediate transfer member 50 and serves as a transfer unit capable of applying a transfer bias for transferring (secondarily transferring) a toner image onto a recording medium 95.

Around the intermediate transfer member 50, a corona charging device 52 for applying charges to the toner image on the intermediate transfer member 50 is disposed between a contact point of the intermediate transfer member 50 with the photoconductor drum 10 and a contact portion of the intermediate transfer member 50 with the recording medium 95.

The developing devices for black (K), yellow (Y), magenta (M) and cyan (C) toners (i.e., a black toner-developing device 45K, a yellow toner-developing device 45Y, a magenta toner-developing device 45M, and a cyan toner-developing device 45C) each contain a developer accommodating section (42K, 42Y, 42M or 42C), a developer supplying roller (43K, 43Y, 43M or 43C) and a developer roller (44K, 44Y, 44M or 44C).

In the image forming apparatus 100A, for example, the charging roller 20 uniformly charges the photoconductor drum 10. The photoconductor drum 10 is imagewise exposed to light 30 emitted from an exposing device (not illustrated) to form a latent electrostatic image. The latent electrostatic image formed on the photoconductor drum 10 is developed with a developer supplied from each of the developing devices (i.e., a black toner-developing device 45K, a yellow toner-developing device 45Y, a magenta toner-developing device 45M, and a cyan toner-developing device 45C), to thereby form a toner image. The toner image is transferred onto the intermediate transfer member 50 (primary transfer) with a transfer bias applied from the rollers 51. The image transferred onto the intermediate transfer member 50 is charged with a corona charging device 52 and then is transferred onto the recording medium 95 (secondary transfer). Notably, toner particles remaining on the photoconductor drum 10 are removed by the cleaning device 60, and charges on the photoconductor drum 10 are removed by the charge-eliminating lamp 70.

Figure 2:
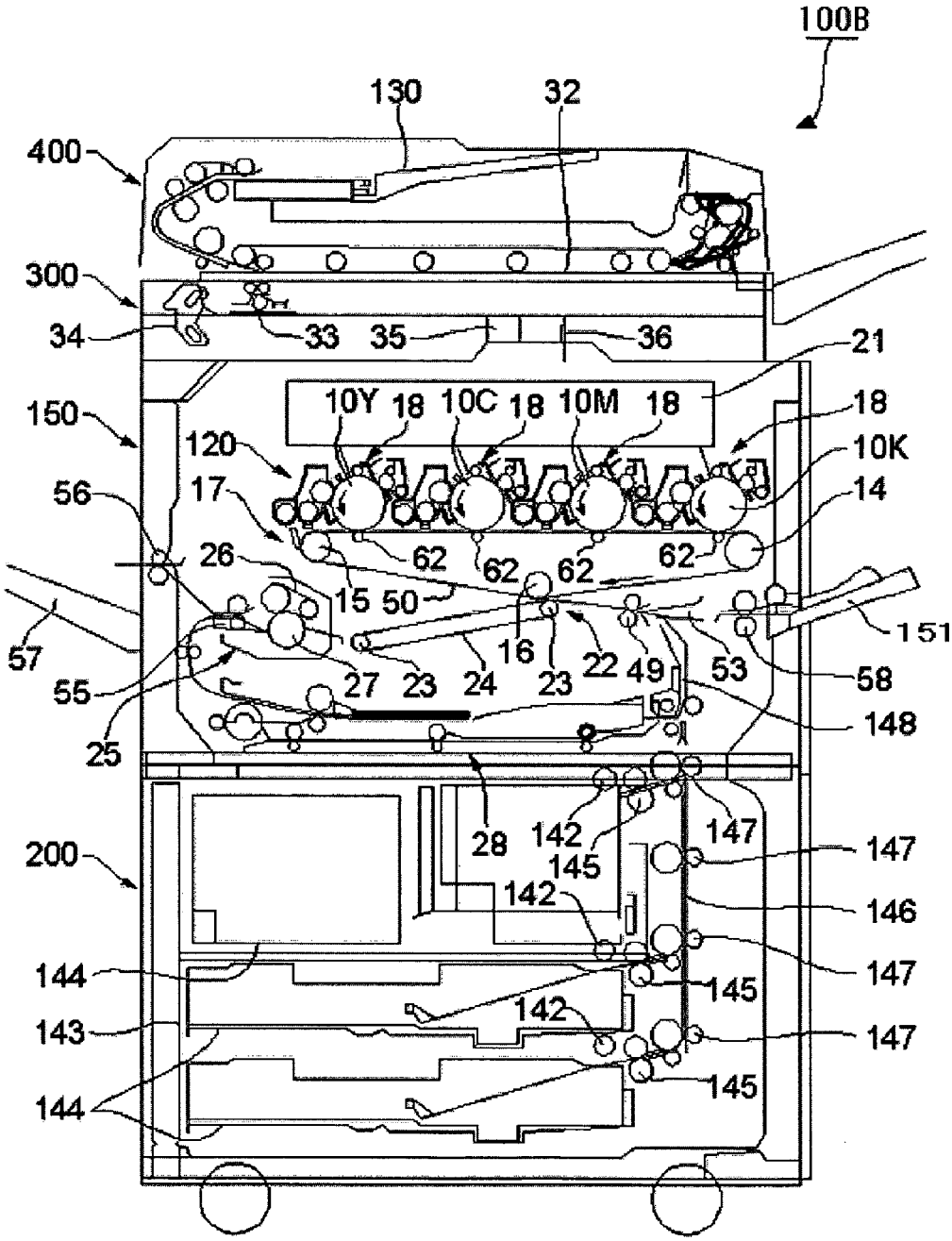
FIG. 2 exemplarily illustrates another image forming apparatus of the present invention.

FIG. 2 exemplarily shows another image forming apparatus of the present invention. An image forming apparatus 100B is a tandem color image forming apparatus, and includes a copying device main body 150, a paper feeding table 200, a scanner 300 and an automatic document feeder (ADF) 400.

The copying device main body 150 is provided at its center portion with an endless belt-shaped intermediate transfer member 50. The intermediate transfer member 50 can be rotated by support rollers 14, 15 and 16 in a direction indicated by an arrow.

Figure 3:
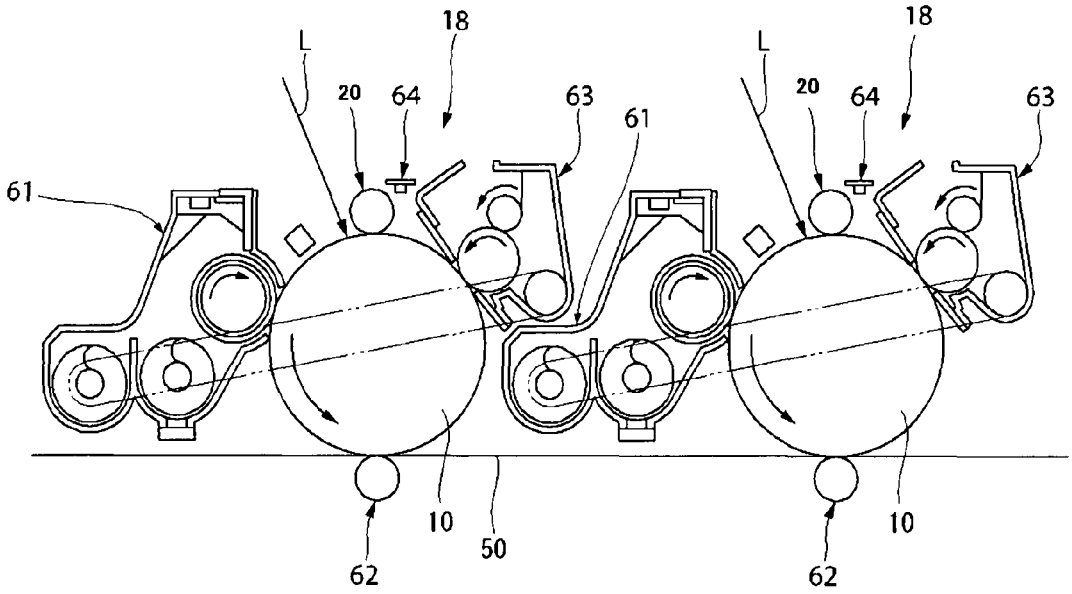
FIG. 3 illustrates a tandem developing device of the image forming apparatus in FIG. 2.

A cleaning device 17 for removing toner particles remaining on the intermediate transfer member 50 is disposed in the vicinity of the support roller 15. Around the intermediate transfer member 50 tightly stretched by support rollers 14 and 15 is provided a tandem developing device 120 in which four image forming units 18 for yellow, cyan, magenta and black toners are arranged in a row along a moving direction of the intermediate transfer member. As shown in FIG. 3, each image forming unit 18 has a photoconductor drum 10, a charging roller 20 which uniformly charges the photoconductor drum 10, a developing device 61 which forms a toner image by developing a latent electrostatic image on the photoconductor drum 10 with a developer of black (K), yellow (Y), magenta (M) or cyan (C), a transfer roller 62 which transfers the toner image onto an intermediate transfer member 50, a cleaning device 63, and a charge-eliminating lamp 64.

An exposing device 21 is provided in the vicinity of the tandem developing device 120. The exposing device 21 applies light L to the photoconductor drum 10 (i.e., a black toner-photoconductor 10K, a yellow toner-photoconductor 10Y, a magenta toner-photoconductor 10M, or a cyan toner-photoconductor 10C) to form a latent electrostatic image.

Also, a secondary transfer device 22 is provided on the intermediate transfer member 50 on the side opposite to the side where the tandem developing device 120 is disposed. The secondary transfer device 22 includes an endless belt-shaped secondary transfer belt 24 and a pair of support rollers 23 tightly stretching the belt. A recording paper fed on the secondary transfer belt 24 can come into contact with the intermediate transfer member 50.

A fixing device 25 is provided in the vicinity of the secondary transfer device 22. The fixing device 25 includes an endless-shaped fixing belt 26 and a press roller 27 provided so as to be pressed against the fixing belt 26.

Also, a sheet reversing device 28 for reversing a recording paper when image formation is performed on both sides of the recording paper is disposed in the vicinity of the secondary transfer device 22 and the fixing device 25.

Next will be described formation of a full color image (color copy) using the image forming apparatus 100B. First, an original document is set on a document table 130 of the automatic document feeder (ADF) 400. Alternatively, the automatic document feeder 400 is opened and then an original document is set on a contact glass 32 of the scanner 300, followed by closing of the automatic document feeder 400. In the former case, when a starting switch (not illustrated) is pressed, the scanner 300 is operated to run a first carriage 33 and a second carriage 34 after the original document has been transferred onto the contact glass 32. In the latter case, when a starting switch (not illustrated) is pressed, the scanner 300 is operated to run a first carriage 33 and a second carriage 34 immediately after the original document has been set on the contact glass 32. At that time, the first carriage 33 irradiates the original document with light from a light source, and then the second carriage 34 reflects, on its mirror, light reflected by the original document. The thus-reflected light is received by a reading sensor 36 through an imaging lens 35 for reading the original document (color image), to thereby form image information corresponding to black, yellow, magenta and cyan.

Further, based on the thus-formed image information, a latent electrostatic image corresponding to each color is formed on the photoconductor drum 10 with the exposing device 21. Subsequently, the latent electrostatic image is developed with a developer supplied from a developing device 61 for each color toner, to thereby form color toner images. The thus-formed color toner images are sequentially superposed (primarily transferred) on the intermediate transfer member 50 which is being rotated by support rollers 14, 15 and 16, whereby a composite toner image is formed on the intermediate transfer member 50.

In the paper feeding table 200, one of paper feeding rollers 142 is selectively rotated to feed recording paper sheets from one of vertically stacked paper feeding cassettes 144 housed in a paper bank 143. The thus-fed sheets are separated from one another by a separating roller 145. The thus-separated sheet is fed through a paper feeding path 146, then fed through a paper feeding path 148 in a copying device main body 150 by a transfer roller 147, and stopped at a resist roller 49. Alternatively, recording paper sheets placed on a manual-feeding tray 151 are fed, and the thus-fed sheets are separated from one another by a separating roller 58. The thus-separated sheet is fed through a manual paper-feeding path 53 and then stopped at a resist roller 49. Notably, the resist roller 49 is generally connected to the ground in use. Alternatively, it may be used while a bias is being applied thereto for removing paper dust from the sheet.

The resist roller 49 is rotated to feed a recording paper sheet between the intermediate transfer member 50 and the secondary transfer device 22 so that the composite toner image formed on the intermediate transfer member 50 is transferred (secondarily transferred) onto the recording paper sheet.

The recording paper sheet having a composite toner image is fed by the secondary transfer device 22 to a fixing device 25. In the fixing device 25, a fixing belt 26 and a press roller 27 fixes the composite toner image on the recording paper sheet through application of heat and pressure. Subsequently, the recording paper sheet is discharged from a discharge roller 56 by a switching claw 55 and then stacked on a discharge tray 57. Alternatively, the recording paper sheet is reversed with the sheet reversing device 28 by a switching claw 55 and conveyed again to a position where transfer is performed. Thereafter, an image is formed on the back surface thereof, and then the thus-obtained sheet is discharged from a discharge roller 56 and stacked on a discharge tray 57.

Notably, a cleaning device 17 removes toner particles remaining on the intermediate transfer member 50 after transfer of the composite toner image.

(Process Cartridge)

A process cartridge of the present invention is molded so as to be detachably mounted to various image forming apparatuses, and includes a latent electrostatic image bearing member for bearing a latent electrostatic image, and a developing unit configured to form a toner image by developing, using the developer of the present invention, the latent electrostatic image formed on the latent electrostatic image bearing member. If necessary, the process cartridge of the present invention may further include other units.

The developing unit includes a developer container for the developer of the present invention, and developer carriers for carrying and transferring the developer held in the developer container. The developing unit may further include a member for adjusting the thickness of the developer to be carried.

Figure 4:
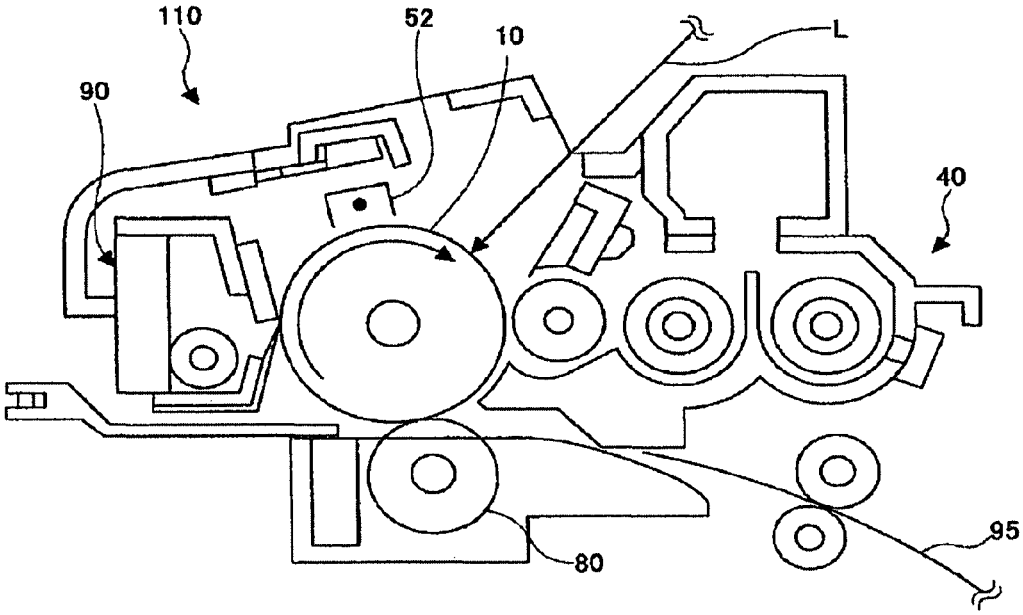
FIG. 4 exemplarily illustrates a process cartridge of the present invention.

FIG. 4 exemplarily shows a process cartridge of the present invention. A process cartridge 110 has a photoconductor drum 10, a corona charging device 52, a developing device 40, a transfer roller 80 and a cleaning device 90.

In FIG. 4, reference characters 95 and L denote a recording medium and light emitted from an unillustrated exposing unit, respectively.

EXAMPLES

The present invention will next be described by way of examples, which should not be construed as limiting the present invention thereto. As described above, the toner production method used in the present invention is not particularly limited. In the Examples, the dissolution suspension method—one of aqueous granulation methods—was used for producing toner. Note that the unit "part(s)" is on a mass basis.

—Synthesis of Polyester Resin A—

A reaction vessel equipped with a condenser, a stirrer and a nitrogen-introducing tube was charged with an ethylene oxide 2-mole adduct of bisphenol A (67 parts), a propylene oxide 3-mole adduct of bisphenol A (84 parts), terephthalic acid (274 parts) and dibutyltin oxide (2 parts), and the mixture was allowed to react at 230° C. for 10 hours under normal pressure. Subsequently, the resultant mixture was allowed to react for 6 hours under reduced pressure (10 mmHg to 15 mmHg), to thereby synthesize a polyester resin. The thus-synthesized polyester resin A was found to have a number average molecular weight (Mn) of 2,300, weight average molecular weight (Mw) of 7,000, glass transition temperature (Tg) of 65° C., acid value of 20 mgKOH/g and hydroxyl value of 40 mgKOH/g.

—Synthesis of Polyester Resin B—

A reaction vessel equipped with a condenser, a stirrer and a nitrogen-introducing tube was charged with an ethylene oxide 2-mole adduct of bisphenol A (77 parts), a propylene oxide 3-mole adduct of bisphenol A (74 parts), terephthalic acid (289 parts) and dibutyltin oxide (2 parts), and the mixture was allowed to react at 230° C. for 8 hours under normal pressure. Subsequently, the resultant mixture was allowed to react for 5 hours under reduced pressure (10 mmHg to 15 mmHg), to thereby synthesize a polyester resin. The thus-synthesized polyester resin B was found to have a number average molecular weight (Mn) of 2,100, weight average molecular weight (Mw) of 5,600, glass transition temperature (Tg) of 62° C., acid value of 35 mgKOH/g and hydroxyl value of 95 mgKOH/g.

—Synthesis of Polyester Resin C—

A reaction vessel equipped with a condenser, a stirrer and a nitrogen-introducing tube was charged with an ethylene oxide 2-mole adduct of bisphenol A (82 parts), a propylene oxide 3-mole adduct of bisphenol A (69 parts), terephthalic acid (294 parts) and dibutyltin oxide (2 parts), and the mixture was allowed to react at 230° C. for 8 hours under normal pressure. Subsequently, the resultant mixture was allowed to react for 5 hours under reduced pressure (10 mmHg to 15 mmHg), to thereby synthesize a polyester resin. The thus-synthesized polyester resin C was found to have a number average molecular weight (Mn) of 2,100, weight average molecular weight (Mw) of 5,600, glass transition temperature (Tg) of 60° C., acid value of 45 mgKOH/g and hydroxyl value of 105 mgKOH/g.

—Synthesis of Polyester Resin D—

A reaction vessel equipped with a condenser, a stirrer and a nitrogen-introducing tube was charged with an ethylene oxide 2-mole adduct of bisphenol A (60 parts), a propylene oxide 3-mole adduct of bisphenol A (92 parts), terephthalic acid (265 parts) and dibutyltin oxide (2 parts), and the mixture was allowed to react at 230° C. for 8 hours under normal pressure. Subsequently, the resultant mixture was allowed to react for 5 hours under reduced pressure (10 mmHg to 15 mmHg), to thereby synthesize a polyester resin. The thus-synthesized polyester resin D was found to have a number average molecular weight (Mn) of 2,100, weight average molecular weight (Mw) of 5,600, glass transition temperature (Tg) of 68° C., acid value of 5 mgKOH/g and hydroxyl value of 5 mgKOH/g.

—Synthesis of Polyester Resin E—

A reaction vessel equipped with a condenser, a stirrer and a nitrogen-introducing tube was charged with an ethylene oxide 2-mole adduct of bisphenol A (55 parts), a propylene oxide 3-mole adduct of bisphenol A (97 parts), terephthalic acid (260 parts) and dibutyltin oxide (2 parts), and the mixture was allowed to react at 230° C. for 8 hours under normal pressure. Subsequently, the resultant mixture was allowed to react for 5 hours under reduced pressure (10 mmHg to 15 mmHg), to thereby synthesize a polyester resin. The thus-synthesized polyester resin E was found to have a number average molecular weight (Mn) of 2,100, weight average molecular weight (Mw) of 5,600, glass transition temperature (Tg) of 70° C., acid value of 3 mgKOH/g and hydroxyl value of 3 mgKOH/g.

—Synthesis of styrene-acrylic resin A—

A reaction vessel equipped with a condenser, a stirrer and a nitrogen-introducing tube was charged with ethyl acetate (300 parts), styrene (200 parts), an acrylic monomer (100 parts) and azobisisobutyronitrile (5 parts), and the mixture was allowed to react in a nitrogen atmosphere at 60° C. (normal pressure) for 8 hours. Subsequently, methanol (200 parts) was added to the resultant mixture, followed by stirring for 1 hour. After removal of the supernatant, the remaining mixture was dried under reduced pressure, to thereby synthesize styrene-acrylic resin A. The thus-synthesized styrene-acrylic resin A was found to have an Mw of 20,000 and Tg of 60° C.

—Preparation of Masterbatch—

Water (1,000 parts), carbon black (Printex 35, product of Deggusa Co., DBP oil-absorption amount: 42 mL/100 g, pH: 9.5) (540 parts) and the above-synthesized polyester resin A (1,200 parts) were mixed one another with a Henschel mixer (product of Mitsui Mining Co.). Using a two-roll mill, the resultant mixture was kneaded at 150° C. for 30 min, followed by calendering and cooling. The product was pulverized with a pulverizer (product of Hosokawa Micron Ltd.) to prepare a masterbatch.

—Preparation of Aqueous Medium—

Ion-exchanged water (306 parts), a 10% by mass suspension of tripotassium phosphate (265 parts) and sodium dodecylbenzenesulfonate (0.2 parts) were mixed with one another. The resultant mixture was homogeneously dissolved to prepare an aqueous medium.

Example 1

Production of Toner

A beaker was charged with polyester resin A (80 parts) and ethyl acetate (100 parts), and the mixture was dissolved under stirring. Subsequently, stearic amide serving as a fixing aid (5 parts) (NEUTRON-2, melting point: 95° C., product of Nippon Fine Chemical), paraffin wax serving as a releasing agent (5 parts) (HNP-11, melting point: 69° C., product of NIPPON SEIRO CO., LTD.) and the above-prepared masterbatch (10 parts) were added to the beaker. The resultant mixture was treated with a bead mill (Ultra Visco Mill, product of Aymex Co.) under the following conditions: liquid-feeding rate: 1 kg/hr; disc circumferential speed: 6 m/sec; amount of 0.5 mm-zirconia beads charged: 80% by volume; and pass time: 3, to thereby prepare a toner material liquid.

The above-prepared aqueous medium (150 parts) was added to a vessel. Subsequently, the toner material liquid (100 parts) was added to the vessel under stirring at 12,000 rpm using a TK Homomixer (product of Tokushu Kika Kogyo Co.), followed by mixing for 10 min, to thereby prepare an emulsified slurry.

The emulsified slurry (100 parts) was charged into a flask equipped with a stirrer and a thermometer. Then, the solvent was removed at 30° C. for 12 hours under stirring at a circumferential speed of 20 m/min, to thereby prepare a dispersion slurry.

The dispersion slurry (100 parts) was filtrated under reduced pressure. Thereafter, ion-exchanged water (100 parts) was added to the filter cake. The resultant mixture was mixed with a TK Homomixer at 12,000 rpm for 10 min, followed by filtration. Subsequently, ion-exchanged water (300 parts) was added to the filter cake, and the resultant mixture was mixed with a TK Homomixer at 12,000 rpm for 10 min, followed by filtration. These treatments (i.e., addition of ion-exchanged water (300 parts), mixing, and filtration) were performed two more times. Subsequently, 10% by mass hydrochloric acid (10 parts) was added to the filter cake, and the resultant mixture was mixed with a TK Homomixer at 12,000 rpm for 10 min, followed by filtration. Then, ion-exchanged water (300 parts) was added to the filter cake, and the resultant mixture was mixed with a TK Homomixer at 12,000 rpm for 10 min, followed by filtration. These treatments (i.e., addition of ion-exchanged water, mixing, and filtration) were performed one more time, whereby a filter cake was obtained.

The thus-obtained filter cake was dried at 45° C. for 48 hours using an air-circulating drier, and then was caused to pass through a sieve with a mesh size of 75 μm, to thereby produce base particles.

The base particles (100 parts) and a hydrophobic silica H2000 serving as an external additive (1.0 part) (product of Clariant Japan) were treated with a Henschel mixer (product of Mitsui Mining Co.) by repeating five times a cycle consisting of mixing them at a circumferential speed of 30 m/sec for 30 sec and suspending the mixing for 1 min. The resultant mixture was caused to pass through a sieve with a mesh size of 35 μm to prepare a toner of Example 1.

Example 2

The procedure of Example 1 was repeated, except that polyester B was used instead of polyester A, to thereby produce a toner of Example 2.

Example 3

The procedure of Example 1 was repeated, except that polyester C was used instead of polyester A, to thereby produce a toner of Example 3.

Example 4

The procedure of Example 1 was repeated, except that polyester D was used instead of polyester A, to thereby produce a toner of Example 4.

Example 5

The procedure of Example 1 was repeated, except that polyester E was used instead of polyester A, to thereby produce a toner of Example 5.

Example 6

The procedure of Example 1 was repeated, except that stearic amide was changed to behenic amide (BNT-11, melting point: 105° C., product of Nippon Fine Chemical), to thereby produce a toner of Example 6.

Example 7

The procedure of Example 1 was repeated, except that stearic amide was changed to oleic amide (NEUTRON, melting point: 72° C., product of Nippon Fine Chemical), to thereby produce a toner of Example 7.

Example 8

The procedure of Example 1 was repeated, except that stearic amide was changed to stearic acid monoethanol amide (PROFAN SME, melting point: 100° C., product of Sanyo Chemical Industries, Ltd.), to thereby produce a toner of Example 8.

Example 9

The procedure of Example 1 was repeated, except that stearic amide was changed to lauric bisethanolamide (PROFAN AA-62EX, melting point: 72° C., product of Sanyo Chemical Industries, Ltd.), to thereby produce a toner of Example 9.

Example 10

The procedure of Example 1 was repeated, except that carnauba wax (WA-05, melting point: 86° C., product of TOAKASEI CO., LTD.) was used as a releasing agent instead of paraffin wax, to thereby produce a toner of Example 10.

Example 11

The procedure of Example 1 was repeated, except that the amount of stearic amide added was changed from 5 parts to 3 parts, to thereby produce a toner of Example 11.

Example 12

The procedure of Example 1 was repeated, except that the amount of stearic amide added was changed from 5 parts to 19 parts, to thereby produce a toner of Example 12.

Example 13

The procedure of Example 1 was repeated, except that the amount of stearic amide added was changed from 5 parts to 2 parts, to thereby produce a toner of Example 13.

Example 14

The procedure of Example 1 was repeated, except that the amount of stearic amide added was changed from 5 parts to 25 parts, to thereby produce a toner of Example 14.

Example 15

The Procedure of Example 1 was Repeated, Except that stearic amide was changed to stearylstearic amide (NIKKAMIDE S, melting point: 95° C., product of Nippon Kasei Chemical Co., Ltd.) and that polyester resin A was changed to polyester resin B, to thereby produce a toner of Example 15.

Example 16

The procedure of Example 1 was repeated, except that stearic amide was changed to stearylstearic bisamide (melting point: 135° C.) and that polyester resin A was changed to polyester resin B, to thereby produce a toner of Example 16.

Example 17

The procedure of Example 1 was repeated, except that stearic amide was changed to oleylpalmitic amide (PNT, melting point: 69° C., product of Nippon Fine Chemical) and that polyester resin A was changed to polyester resin B, to thereby produce a toner of Example 17.

Example 18

The procedure of Example 1 was repeated, except that stearic amide was changed to stearylerucic amide (SNT, melting point: 78° C., product of Nippon Fine Chemical) and that polyester resin A was changed to polyester resin B, to thereby produce a toner of Example 18.

Comparative Example 1

The procedure of Example 1 was repeated, except that the amount of stearic amide added was 0 parts, to thereby produce a toner of Comparative Example 1.

Comparative Example 2

The procedure of Example 1 was repeated, except that stearic amide was changed to ethylene bisoleic amide (SLI- PAX 0, melting point: 119° C., product of Nippon Kasei Chemical Co., Ltd.), to thereby produce a toner of Comparative Example 2.

Comparative Example 3

The procedure of Example 1 was repeated, except that polyester resin A was changed to styrene-acrylic resin A, to thereby produce a toner of Comparative Example 3.

Comparative Example 4

The procedure of Example 1 was repeated, except that stearic amide was changed to ethylene bisstearic amide (SLIPAX E, melting point: 145° C., product of Nippon Kasei Chemical Co., Ltd.), to thereby produce a toner of Comparative Example 5.

As described above, toners of Examples 1 to 18 and Comparative Examples 1 to 4 were produced. Table 1 shows a resin, a fatty acid amide-based compound and a releasing agent used in each toner.

TABLE 1

| Toner | Resin | Fatty acid amide-based compound | Releasing agent | Tgr-Tgr' |
|---|---|---|---|---|
| Ex. 1 | Polyester resin A | Stearic amide | Paraffin | 20 |
| Ex. 2 | Polyester resin B | Stearic amide | Paraffin | 23 |
| Ex. 3 | Polyester resin C | Stearic amide | Paraffin | 25 |
| Ex. 4 | Polyester resin D | Stearic amide | Paraffin | 15 |
| Ex. 5 | Polyester resin E | Stearic amide | Paraffin | 10 |
| Ex. 6 | Polyester resin A | Behenic amide | Paraffin | 15 |
| Ex. 7 | Polyester resin A | Oleic amide | Paraffin | 20 |
| Ex. 8 | Polyester resin A | Stearic acid monoethanol amide | Paraffin | 15 |
| Ex. 9 | Polyester resin A | Lauric bisethanolamide | Paraffin | 17 |
| Ex. 10 | Polyester resin A | Stearic amide | Carnauba | 20 |
| Ex. 11 | Polyester resin A | Stearic amide | Paraffin | 20 |
| Ex. 12 | Polyester resin A | Stearic amide | Paraffin | 20 |
| Ex. 13 | Polyester resin A | Stearic amide | Paraffin | 20 |
| Ex. 14 | Polyester resin A | Stearic amide | Paraffin | 20 |
| Ex. 15 | Polyester resin B | Stearylstearic amide | Paraffin | 15 |
| Ex. 16 | Polyester resin B | Stearylstearic bisamide | Paraffin | 15 |
| Ex. 17 | Polyester resin B | Oleylpalmitic amide | Paraffin | 17 |
| Ex. 18 | Polyester resin B | Stearylerucic amide | Paraffin | 15 |
| Comp. Ex. 1 | Polyester resin A | Not added | Paraffin | — |
| Comp. Ex. 2 | Polyester resin A | Ethylene bisoleic amide | Paraffin | 10 |
| Comp. Ex. 3 | Styrene-acrylic resin A | Stearic amide | Paraffin | 5 |
| Comp. Ex. 4 | Polyester resin A | Ethylene bisstearic amide | Paraffin | 5 |

Also, in each of the toners of Examples 1 to 18 and Comparative Examples 1 to 4, the resin used was measured for glass transition temperature (Tgr) with a differential scanning calorimeter (DSC) system ("DSC-60", product of Shimadzu Corporation) in accordance with the following procedure. Separately, the resin containing a fixing aid (10 parts) was measured for glass transition temperature (Tgr') similar to the above. Table 1 shows a value calculated by subtracting Tgr' from Tgr.

—Measurements of Tgr and Tgr'—

First, a resin (about 5.0 mg) was placed in a sample container made of aluminum; the sample container was placed on a holder unit; and the holder unit was set in an electric furnace. Using a differential scanning calorimeter ("DSC-60", product of Shimadzu Corporation), a DSC curve of the resin was obtained by increasing or decreasing the temperature of the resin in a nitrogen atmosphere as follows. Specifically, it was heated from 20° C. to 150° C. at a temperature increasing rate of 10° C./rain; it was cooled from 150° C. to 0° C. at a temperature decreasing rate of 10° C./rain; and it was heated again to 150° C. at a temperature increasing rate of 10° C./min. Using the thus-obtained DSC curve and an analysis program of a DSC-60 system, a glass transition temperature (Tgr) of the resin was calculated in a shoulder of the DSC curve corresponding to the second temperature increase.

Similarly, the resin containing a fixing aid (10 parts) was measured for glass transition temperature (Tgr').

First, a fixing aid (0.5 mg) and a resin (4.5 mg) were placed in a sample container made of aluminum; the sample container was placed on a holder unit; and the holder unit was set in an electric furnace. Using a differential scanning calorimeter, a DSC curve of the mixture was obtained by increasing or decreasing the temperature of the mixture in a nitrogen atmosphere as follows. Specifically, it was heated from 20° C. to 150° C. at a temperature increasing rate of 10° C./min; it was cooled from 150° C. to 0° C. at a temperature decreasing rate of 10° C./min; and it was heated again to 150° C. at a temperature increasing rate of 10° C./min. Using the thus-obtained DSC curve and an analysis program of a DSC-60 system, the glass transition temperature (Tgr') of the fixing aid-containing resin was calculated in a shoulder of the DSC curve corresponding to the second temperature increase.

Using each of the toners of Examples 1 to 18 and Comparative Examples 1 to 4, a developer was produced in accordance with the below-given procedure and then evaluated as follows. The results are shown in Table 2.

<Preparation of Carrier>

A silicone resin (organostraight silicone) (100 parts), γ-(2-aminoethyl)aminopropyltrimethoxysilane (5 parts) and carbon black (10 parts) were added to toluene (100 parts), and the resultant mixture was dispersed with a homomixer for 20 min, to thereby prepare a resin layer coating liquid. Subsequently, using a fluid bed coater, the resin layer coating liquid was applied on the surfaces of spherical magnetite particles (1,000 parts) having an average particle diameter of 50 μm, whereby a carrier was prepared.

<Production of Developer>

Using a ball mill, the toner (5 parts) and the above-prepared carrier (95 parts) were mixed with each other to produce a developer.

[Evaluation]

—Minimum Fixing Temperature—

A fixing portion of the copier MF-200 (product of Ricoh Company, Ltd.) employing a TEFLON (registered trade mark) roller as a fixing roller was modified to produce a modified copier. The above-produced developer and Type 6200 paper sheets (product of Ricoh Company, Ltd.) were set in the modified copier, and printing was performed while changing the temperature of the fixing roller in 5° C. steps. Subsequently, a pat was rubbed against the obtained fixed images. The minimum fixing temperature was defined as the minimum value of the fixing roller's temperatures at which the image density of the thus-rubbed image was 70% or higher.

The minimum fixing temperature is preferably lower from the viewpoint of reducing power consumption. Toners having a minimum fixing temperature of 135° C. or lower are practically applicable.

—Hot Offset-Occurring Temperature—

The tandem-type color electrophotographic apparatus Imagio Neo C350 (product of Ricoh Company, Ltd.) was modified to have an oil-less fixing system by removing a silicone oil application mechanism from its fixing unit. The resultant electrophotographic apparatus was tuned so as to be able to adjust the temperature and the linear velocity. The thus-obtained tandem-type color electrophotographic apparatus was adjusted so that the amount of toner used for development was 0.85±0.3 mg/cm$^2$. Image formation was performed using the electrophotographic apparatus, and the formed images were fixed while changing the temperature of the fixing roller in 5° C. steps. In this image fixation, the fixing temperature at which hot offset occurred (hot offset-occurring temperature) was measured, and the maximum fixing temperature was defined as the maximum value of the fixing roller's temperatures at which image fixation was performed without involving hot offset.

The maximum fixing temperature is preferably higher from the viewpoint of enhancing hot offset resistance. Toners having a maximum fixing temperature of 190° C. or higher are practically applicable.

—Transfer Rate—

Using the image forming apparatus MF2800 (product of Ricoh Company, Ltd.), there was formed a 15 cm×15 cm black solid image whose average image density was 1.38 or higher as measured by a Macbeth reflection densitometer. The transfer rate of toner in the image was calculated using the following formula (I).

Transfer rate %=(amount of toner transferred onto recoding paper/amount of toner adsorbed on photoconductor)×100 (1)

Notably, the transfer rate was evaluated in accordance with the following criteria.

A: Transfer rate≥90%

B: 80%≤transfer rate<90%

C: 70%≤transfer rate<80%

D: Transfer rate<70%

—Uneven Transfer—

A black solid image was formed using the image forming apparatus MF2800 (product of Ricoh Company, Ltd.), and the thus-formed image was visually observed and evaluated for uneven transfer.

The evaluation was based on the following criteria.

A: No uneven transfer; i.e., very good transfer state, was observed

B: Almost no uneven transfer was observed, and non-problematic in practical use

C: Uneven transfer was slightly observed, but practically applicable

D: Uneven transfer was observed, and problematic in practical use

—Fogging—

Using the tandem-type color electrophotographic apparatus Imagio Neo 450 (product of Ricoh Company, Ltd.) having a cleaning blade and a charging roller each being provided so as to be in contact with a photoconductor, 10,000 copies of a laterally-set A4 chart (image pattern A) having a pattern formed by alternatingly repeating a 1 cm black solid portion and 1 cm white solid portion were printed out in a direction perpendicular to the rotating direction of the developing sleeve. Thereafter, a blank image was printed out, and the printed image was visually evaluated for fogging.

The evaluation was based on the following criteria.

A: No fogging observed

B: Fogging observed

—Filming—

Printing of 10,000 images was performed using the image forming apparatus MF2800 (product of Ricoh Company, Ltd.), and then the photoconductor was visually observed and evaluated for adhesion of toner components, particularly a releasing agent, onto the photoconductor.

The evaluation was based on the following criteria.

A: No adhesion of toner component onto photoconductor was observed

B: Adhesion of toner component onto photoconductor was observed to such an extent that it did not involve problems in practical use C: Adhesion of toner component onto photoconductor was observed to such an extent that it involved problems in practical use —Heat Resistance/Storage Stability—

In evaluation of heat resistance/storage stability, each toner was used rather than each developer.

Specifically, a 50 mL-glass container was filled with the toner, and then left to stand for 24 hours in a thermostat bath whose temperature had been set to 50° C. After cooled to 24° C., the container was subjected to a penetration test (JIS K2235-1991) to measure a penetration. Based on the thus-measured penetration, heat resistance/storage stability of the toner was evaluated in accordance with the following criteria.

A: Penetration≥25 mm

B: 15 mm≤penetration<25 mm

C: 5 mm≤penetration<15 mm

D: Penetration<5 mm

The larger the penetration of the toner, the better the heat resistance/storage stability thereof. Toners having a penetration smaller than 5 mm are highly likely to involve problems in use.

TABLE 2

| | Fixing property | | Transferability | | | | |
|---|---|---|---|---|---|---|---|
| | Minimum fixing temperature | Hot offset-occurring temperature | Transfer rate | Uneven transfer | Heat resistance/ storage stability | Fogging | Filming |
| Ex. 1 | 115° C. | 200° C. | A | A | B | A | A |
| Ex. 2 | 115° C. | 200° C. | A | B | B | A | A |
| Ex. 3 | 115° C. | 195° C. | B | B | C | A | A |

TABLE 2-continued

| | Fixing property | | Transferability | | | | |
|---|---|---|---|---|---|---|---|
| | Minimum fixing temperature | Hot offset-occurring temperature | Transfer rate | Uneven transfer | Heat resistance/ storage stability | Fogging | Filming |
| Ex. 4 | 120° C. | 200° C. | A | A | A | A | A |
| Ex. 5 | 125° C. | 205° C. | A | A | A | A | A |
| Ex. 6 | 120° C. | 200° C. | A | A | B | A | A |
| Ex. 7 | 115° C. | 195° C. | A | B | B | A | A |
| Ex. 8 | 120° C. | 200° C. | A | A | B | A | A |
| Ex. 9 | 120° C. | 200° C. | A | A | B | A | A |
| Ex. 10 | 125° C. | 190° C. | A | A | B | A | A |
| Ex. 11 | 125° C. | 200° C. | A | A | B | A | A |
| Ex. 12 | 115° C. | 195° C. | B | B | B | A | A |
| Ex. 13 | 125° C. | 200° C. | A | A | B | A | A |
| Ex. 14 | 115° C. | 190° C. | B | B | C | A | A |
| Ex. 15 | 120° C. | 200° C. | A | A | A | A | A |
| Ex. 16 | 125° C. | 195° C. | A | A | A | A | A |
| Ex. 17 | 120° C. | 190° C. | B | B | C | A | A |
| Ex. 18 | 120° C. | 190° C. | B | B | A | A | A |
| Comp. Ex. 1 | 145° C. | 200° C. | A | A | B | A | A |
| Comp. Ex. 2 | 140° C. | 200° C. | A | A | B | A | A |
| Comp. Ex. 3 | 140° C. | 185° C. | B | B | C | B | A |
| Comp. Ex. 4 | 140° C. | 185° C. | B | B | B | A | A |

As shown in Table 2, the toners of Examples 1 to 18, each containing a polyester resin excellent in low-temperature fixing property, and a fatty acid amide-based compound serving as a fixing aid and being excellent in compatibility with the polyester resin (i.e., at least one of a fatty acid amide compound having a mono- or higher valent amide bond and a fatty acid amide-based compound having a mono- or higher valent amino group or a hydroxyl group) and thus, were found to be excellent in low-temperature fixing property and offset resistance. Furthermore, the fatty acid amide compound exists in the toners as independent crystalline domains, resulting in excellent transferablity. In addition, no image fogging and no filming are caused, making it possible to form high-quality images for a long period of time.

Unlike Example 1, the toner of Comparative Example 1 contains no fixing aid. Thus, it was found to exhibit a poor low-temperature fixing property.

The toner of Comparative Example 2 contains a fatty acid amide-based compound having a high melting temperature and thus, was found to exhibit a low-temperature fixing property.

The toner of Comparative Example 3 contains a styrene-acrylic resin rather than a polyester resin and thus, was found to exhibit an insufficient low-temperature fixing property. Also, since the styrene-acrylic resin is inferior in compatibility with the fixing aid to the polyester resin, the toner was found to exhibit an insufficient low-temperature fixing property.

The toner of Comparative Example 4 contains a compound (fixing aid) having a structure different from that of the fatty acid amide-based compound used in the present invention. The fixing aid contained in the toner is poorly compatible with the binder resin and thus, insufficiently softens the toner. This toner, therefore, was found to exhibit an insufficient low-temperature fixing property.

Through the above-described discussion, the toner of the present invention is excellent in low-temperature fixing property and offset resistance and thus, does not easily contaminate a fixing device and/or an image. The toner of the present invention can provide a high-quality toner image for a long period of time.

The invention claimed is:

1. A toner comprising:

at least one polyester resin which is a binder resin, a colorant, a releasing agent, and a fixing aid which exists in the toner in crystalline domains prior to fixing, then is compatible with and softens the binder resin upon heating during fixing, wherein the fixing aid comprises a fatty acid amide-based compound, and the fatty acid amide-based compound is at least one selected from the group consisting of a fatty acid amide compound having a mono- or higher valent amide bond and a fatty acid amide-based compound having a mono- or higher valent amino group or a hydroxyl group, wherein the fatty acid amide-based compound has a melting point of 70° C. or higher and lower than 100° C.

2. The toner according to claim 1, wherein the fatty acid amide-based compound is any one of a monoamide compound and an alcohol adduct thereof.

3. The toner according claim 1, wherein the fatty acid amide compound is a linear fatty acid amide compound having a monovalent amide bond which compound is obtained by reacting ammonia with a linear fatty acid.

4. The toner according claim 1, wherein the releasing agent is a hydrocarbon wax having a melting point of 60° C. or higher and lower than 90° C.

5. The toner according to claim 1, wherein the at least one polyester resin has an acid value of 5 mgKOH/g or higher and lower than 40 mgKOH/g.

6. The toner according to claim 1, wherein the at least one polyester resin has an acid value of 10 mgKOH/g or higher and lower than 30 mgKOH/g.

7. The toner according to claim 1, wherein the at least one polyester resin has a hydroxyl value of 5 mgKOH/g or higher and lower than 100 mgKOH/g.

8. The toner according to claim 1, wherein the at least one polyester resin has a hydroxyl value of 20 mgKOH/g or higher and lower than 60 mgKOH/g.

9. The toner according to claim 1, wherein the at least one polyester resin has a glass transition temperature Tg of 55° C. or higher and lower than 80° C.

10. The toner according to claim 1, wherein the toner satisfies Tgr−Tgr'>10° C., wherein Tgr denotes a glass transition temperature of the at least one polyester resin, and Tgr' denotes a glass transition temperature of a mixture of 90 parts by mass of the at least one polyester resin and 10 parts by mass of the fixing aid, which is measured after heating the mixture at 150° C.

11. The toner according to claim 1, wherein an amount of the fixing aid comprised in the toner is 2% by mass or more and less than 25% by mass with respect to a total amount of the toner.

12. The toner according to claim 1, wherein the toner is produced in an aqueous medium.

13. An image forming method comprising:

forming a latent electrostatic image on a latent electrostatic image bearing member, developing the latent electrostatic image with a toner to form a visible image, transferring the visible image onto a recording medium, and fixing the transferred image on the recording medium, wherein the toner is the toner according to claim 1.

14. The toner of claim 1, wherein the fatty acid amide-based compound is at least one selected from the group consisting of a fatty acid primary amide, a fatty acid secondary amide, a fatty acid tertiary amide, a fatty acid primary amide having an amino group at its fatty acid alkyl terminus, a fatty acid secondary amide having an amino group at its fatty acid alkyl terminus and/or N-alkyl terminus, a fatty acid tertiary amide having an amino group at its fatty acid alkyl terminus and/or at least one N-alkyl terminus, a fatty acid primary amide having a hydroxyl group at its fatty acid alkyl terminus, a fatty acid secondary amide having a hydroxyl group at its fatty acid alkyl terminus and/or N-alkyl terminus, and a fatty acid tertiary amide having a hydroxy group at its fatty acid alkyl terminus and/or at least one N-alkyl terminus.

15. A toner comprising:

at least one polyester resin which is a binder resin, a colorant, a releasing agent, wherein the releasing agent is a hydrocarbon wax having a melting point of 60° C. or higher and lower than 90° C., and a fixing aid which exists in the toner in crystalline domains prior to fixing, then is compatible with and softens the binder resin upon heating during fixing, wherein the fixing aid comprises a fatty acid amide-based compound, and the fatty acid amide-based compound is at least one selected from the group consisting of a fatty acid amide compound having a mono- or higher valent amide bond and a fatty acid amide-based compound having a mono- or higher valent amino group or a hydroxyl group, wherein the fatty acid amide-based compound has a melting point of 70° C. or higher and lower than 120° C.

16. The toner according to claim 15, wherein the fatty acid amide-based compound is any one of a monoamide compound and an alcohol adduct thereof, or is a linear fatty acid amide compound having a monovalent amide bond which compound is obtained by reacting ammonia with a linear fatty acid.

17. An image forming method comprising:

forming a latent electrostatic image on a latent electrostatic image bearing member, developing the latent electrostatic image with a toner to form a visible image, transferring the visible image onto a recording medium, and fixing the transferred image on the recording medium, wherein the toner is the toner according to claim 15.

* * * * *